US010714874B1

(12) United States Patent
McNutt et al.

(10) Patent No.: US 10,714,874 B1
(45) Date of Patent: Jul. 14, 2020

(54) METHODS FOR MANUFACTURING SHIELD STRUCTURES FOR USE IN COMMUNICATION CABLES

(71) Applicant: Superior Essex International LP, Atlanta, GA (US)

(72) Inventors: Christopher W. McNutt, Woodstock, GA (US); Thibaut Oscar Lanoe, Atlanta, GA (US); Bernhart A. Gebs, Powder Springs, GA (US)

(73) Assignee: Superior Essex International LP, Atlanta, GA (US)

( * ) Notice: Subject to any disclaimer, the term of this patent is extended or adjusted under 35 U.S.C. 154(b) by 22 days.

(21) Appl. No.: 16/116,143

(22) Filed: Aug. 29, 2018

Related U.S. Application Data

(63) Continuation-in-part of application No. 14/879,367, filed on Oct. 9, 2015, now Pat. No. 10,102,946, and
(Continued)

(51) Int. Cl.
*H01R 13/00* (2006.01)
*H01R 11/00* (2006.01)
(Continued)

(52) U.S. Cl.
CPC ..... *H01R 13/6581* (2013.01); *H01B 11/04* (2013.01); *H01B 11/1869* (2013.01); *H01B 11/1873* (2013.01); *Y10T 156/1057* (2015.01)

(58) Field of Classification Search
CPC .... H01R 13/6581; H01B 11/06; H01B 11/08; H01B 11/1869; H01B 11/1008; B29C 70/885
See application file for complete search history.

(56) References Cited

U.S. PATENT DOCUMENTS 2,538,019 A 1/1951 Lee
2,796,463 A 6/1957 Mallindrodt
(Continued)

FOREIGN PATENT DOCUMENTS

GB 2432963 6/2007
JP 2000090748 3/2000
(Continued)

OTHER PUBLICATIONS

Non-Final Office Action for U.S. Appl. No. 16/106,258, dated Jul. 29, 2019.
(Continued)

*Primary Examiner* — Linda L Gray

(57) ABSTRACT

Methods for forming continuous shields for use in a cable are provided. A first layer of longitudinally extending dielectric material may be provided, and a second layer of longitudinally extending electrically conductive material may be formed on the first layer. At a plurality of spaced locations along a longitudinal direction, respective gaps may be formed through both the first layer and the second layer, and each gap may span partially across a width of the second layer. Additionally, at each of the plurality of spaced locations, the gaps may result in the formation of one or more fusible elements of the electrically conductive material spanning between an adjacent set of longitudinally spaced segments of the electrically conductive material. Each fusible element may provide electrical continuity between the adjacent set of longitudinally spaced segment and may further have a minimum fusing current between 0.001 amperes and 0.500 amperes.

20 Claims, 16 Drawing Sheets

Related U.S. Application Data a continuation-in-part of application No. 16/106,258, filed on Aug. 21, 2018, now Pat. No. 10,593,502.

(51) Int. Cl.

| | |
|---|---|
| ***H01R 13/6581*** | (2011.01) |
| ***H01B 11/18*** | (2006.01) |
| ***H01B 11/04*** | (2006.01) |

(56) References Cited

U.S. PATENT DOCUMENTS

| | | | | |
|---|---|---|---|---|
| 3,090,825 | A | | 5/1963 | Volk |
| 3,135,935 | A | | 6/1964 | Eugelbrecht |
| 3,312,774 | A | | 4/1967 | Drinko |
| 3,373,475 | A | | 3/1968 | Peterson |
| 3,439,111 | A | | 4/1969 | Miracle |
| 3,612,744 | A | | 10/1971 | Thomas |
| 4,129,841 | A | | 12/1978 | Hilderbrand et al. |
| 4,327,246 | A | | 4/1982 | Kincaid |
| 4,604,497 | A | | 8/1986 | Bell et al. |
| 4,638,272 | A | | 1/1987 | Ive |
| 4,746,767 | A | | 5/1988 | Gruhn |
| 4,855,534 | A | | 8/1989 | O'Connor |
| 4,881,642 | A | | 11/1989 | Adam |
| 4,912,283 | A | | 3/1990 | O'Connor |
| 4,954,383 | A | * | 9/1990 | King ..... B29C 70/885 156/250 |
| 5,006,806 | A | | 4/1991 | Rippingale |
| 5,008,489 | A | | 4/1991 | Weeks et al. |
| 5,106,175 | A | | 4/1992 | Davis et al. |
| 5,114,517 | A | | 5/1992 | Rippingale et al. |
| 5,300,899 | A | | 4/1994 | Suski |
| 5,473,336 | A | | 12/1995 | Harman et al. |
| 5,952,615 | A | | 9/1999 | Prudhon |
| 5,956,445 | A | | 9/1999 | Deitz et al. |
| 6,207,901 | B1 | | 3/2001 | Smith et al. |
| 6,506,976 | B1 | | 1/2003 | Neveux, Jr. |
| 6,677,518 | B2 | | 1/2004 | Hirakawa et al. |
| 6,687,437 | B1 | | 2/2004 | Starnes et al. |
| 6,723,925 | B2 | | 4/2004 | Ohara et al. |
| 6,737,574 | B2 | | 5/2004 | Sylvia et al. |
| 6,770,819 | B2 | | 8/2004 | Patel |
| 6,831,231 | B2 | | 12/2004 | Perelman et al. |
| 6,843,660 | B2 | | 1/2005 | Barr et al. |
| 6,850,161 | B1 | | 2/2005 | Elliott |
| 6,888,070 | B1 | | 5/2005 | Prescott |
| 6,927,343 | B2 | | 8/2005 | Watanabe et al. |
| 6,972,493 | B2 | | 12/2005 | Ushiyama et al. |
| 7,173,189 | B1 | | 2/2007 | Hazy et al. |
| 7,179,999 | B2 | | 2/2007 | Clark et al. |
| 7,208,683 | B2 | | 4/2007 | Clark |
| 7,332,676 | B2 | | 2/2008 | Sparrowhawk |
| 7,335,837 | B2 | | 2/2008 | Pfeiler et al. |
| 7,600,723 | B2 | | 10/2009 | Borche |
| 7,834,270 | B2 | | 11/2010 | Zhu et al. |
| 7,923,632 | B2 | | 4/2011 | Smith et al. |
| 7,923,641 | B2 | | 4/2011 | Smith et al. |
| 8,119,906 | B1 | | 2/2012 | Smith et al. |
| 8,445,787 | B2 | | 5/2013 | Nordin et al. |
| 8,558,115 | B2 | | 10/2013 | Jenner et al. |
| 9,241,400 | B2 | | 1/2016 | Shaw et al. |
| 9,424,964 | B1 | | 8/2016 | Kithuka et al. |
| 9,767,939 | B2 | | 9/2017 | Hess |
| 2005/0118391 | A1 | | 6/2005 | Kavvadias |
| 2006/0048961 | A1 | | 3/2006 | Pfeiler et al. |
| 2007/0037419 | A1 | | 2/2007 | Sparrowhawk |
| 2007/0224495 | A1 | | 9/2007 | Gibbons et al. |
| 2007/0275583 | A1 | | 11/2007 | McNutt et al. |
| 2008/0255435 | A1 | | 10/2008 | Al-Ali et al. |
| 2008/0314636 | A1 | | 12/2008 | Ogura |
| 2009/0200060 | A1 | | 8/2009 | Smith et al. |
| 2009/0223694 | A1 | | 9/2009 | Nordin et al. |
| 2009/0272571 | A1 | | 11/2009 | Gromko |
| 2010/0096179 | A1 | | 4/2010 | Sparrowhawk et al. |
| 2010/0101853 | A1 | | 4/2010 | McNutt et al. |
| 2010/0224385 | A1 | | 9/2010 | Jenner et al. |
| 2011/0147039 | A1 | | 6/2011 | Smith et al. |
| 2013/0140084 | A1 | | 6/2013 | Sarangapani et al. |
| 2016/0037691 | A1 | | 2/2016 | Kroushl et al. |

FOREIGN PATENT DOCUMENTS

| | | |
|---|---|---|
| JP | 2006173044 | 6/2006 |
| WO | WO2006105166 | 5/2006 |

OTHER PUBLICATIONS

"Product Catalogue" 2 pages, Enterprise Cabling R&M, May 2006.
"Draka" 12 pages, Draka Comtez, Cable Solutions, Data Cables, Sep. 27, 2006.
"10 Gigabit Ethernet Solutions" 8 pages. R&M Convincing Cabling Solutions.
Wetzikon, "R&M: THe Rising Stars in Copper Cabling" 2 pages, Sep. 1, 2005.
"R&M Star Real 10" 2 pages, Mar. 2006.
"Connections 29" 36 pages, Sep. 2005.
Disclosure Statement under 1.56.
Notice of Allowance for U.S. Appl. No. 16/106,258 dated Dec. 2, 2019.

* cited by examiner

1355

1360

1365

1370

METHODS FOR MANUFACTURING SHIELD STRUCTURES FOR USE IN COMMUNICATION CABLES

CROSS-REFERENCES TO RELATED APPLICATIONS

This application is a continuation-in-part of pending U.S. patent application Ser. No. 14/879,367, filed Oct. 9, 2015 and entitled "Methods for Manufacturing Discontinuous Shield Structures for Use in Communication Cables". Additionally, this application is a continuation-in-part of pending U.S. patent application Ser. No. 16/106,258, filed Aug. 21, 2018 and entitled "Fusible Continuous Shields for Use in Communication Cables". This application is also related to U.S. patent application Ser. No. 14/879,393, filed Oct. 9, 2015 and entitled "Discontinuous Shield Structures for Use in Communication Cables". The entire contents of each of these matters are incorporated by reference herein.

TECHNICAL FIELD

Embodiments of the disclosure relate generally to communication cables and, more particularly, to methods for manufacturing continuous shield structures including fusible elements for use in communication cables.

BACKGROUND

As the desire for enhanced communication bandwidth escalates, transmission media need to convey information at higher speeds while maintaining signal fidelity and avoiding crosstalk, including alien crosstalk. However, effects such as noise, interference, crosstalk, alien crosstalk, and/or alien equal-level far-end crosstalk ("ELFEXT") can strengthen with increased data rates, thereby degrading signal quality or integrity. For example, when two cables are disposed adjacent to one another, data transmission in one cable can induce signal problems in the other cable via crosstalk interference.

One approach to addressing crosstalk between communication cables is to circumferentially encase one or more conductors in a shield. Certain shields are designed as discontinuous or segmented shields that include separate patches of metallic material formed on a dielectric material. However, current segmented shield designs are typically manufactured by applying a continuous metallic layer to a dielectric layer, and then either "kiss-cutting" or etching gaps or spaces through the metallic layer. In a kiss-cutting process, the metallic layer is cut with a blade or laser without also penetrating or cutting the dielectric layer, and small sections of the metallic layer are removed. This is a relatively expensive process that requires special tooling and processing expertise. In an etching process, an acid or other agent is utilized to selectively remove portions of the metallic layer in order to form gaps or spaces. These conventional manufacturing processes are typically time-consuming, resulting in slower processing line speeds and an overall higher cost. For example, certain conventional discontinuous shield manufacturing processes typically operate at line speeds of approximately fifteen meters per minute. As a result of the relatively slow processing speeds, the discontinuous shields cannot be integrated into cables in an in-line manner.

Other shields are formed as continuous shields, such as a flexible metallic tube or a foil that coaxially surrounds the cable's conductors. However, complications can arise when a shield is electrically continuous between the two ends of the cable. The continuous shield can inadvertently carry voltage and current along the cable, for example from one terminal device at one end of the cable towards another terminal device at the other end of the cable. Signals carried along the shield can damage equipment connected to a cable and, in some cases, may pose a shock hazard. Loop currents that develop on the shields can also interfere with signals transmitted by the cable.

Accordingly, there is an opportunity for improved continuous shields that include fusible elements that break down in the event that a sufficient current is present on the shield. There is additionally an opportunity for improved methods, techniques, and/or systems for forming or manufacturing continuous shield structures that include fusible elements. There is additionally an opportunity for improved shield manufacturing methods and/or systems that may be carried out in a relatively faster and cost-effective manner and/or in-line with a cable assembly process.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1:
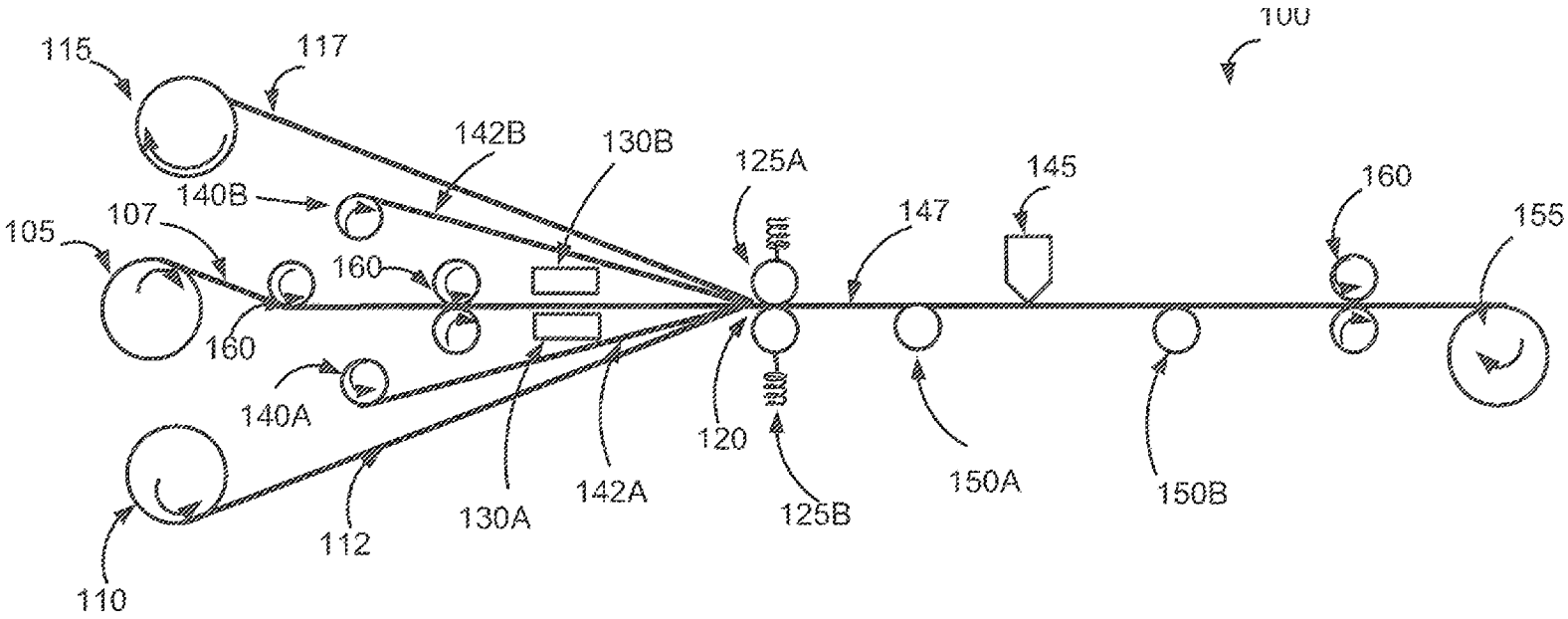
FIGS. 1-4 are block diagrams of example systems that may be utilized to manufacture or form continuous shield structures, according to an illustrative embodiment of the disclosure.

Various embodiments of the present disclosure are directed to methods, techniques, and/or systems for manufacturing or otherwise forming shield structures for use in conjunction with cables. In certain example embodiments, a base layer of dielectric material may be provided, and a layer of electrically conductive or shielding material may be formed on the base layer. For example, an electrically conductive layer may be adhered to a base layer, deposited on a base layer, or otherwise formed on a base layer. The base layer and the electrically conductive layer may extend in a longitudinal direction. In certain embodiments, the base layer may have a first width that is greater than a second width of the electrically conductive layer. In other embodiments, the base layer and the electrically conductive layer may have approximately equal widths.

Once an electrically conductive layer has been formed on a base layer, a plurality of longitudinally spaced gaps or holes may be formed through the electrically conductive layer and the base layer. One or more gaps or holes may be formed at each of a plurality of longitudinally spaced locations. Each gap may span partially across the width of the electrically conductive layer. Additionally, at each of the plurality of longitudinally spaced locations, the one or more respective gaps may result in the formation of one or more fusible elements of the electrically conductive material spanning between an adjacent set of longitudinally spaced segments of the electrically conductive material.

The fusible element(s) formed between two longitudinally spaced segments of electrically conductive material may provide electrical continuity between the longitudinally spaced segments of electrically conductive material, thereby resulting in the shield structure being electrically continuous along its longitudinal length. In the absence of the fusible elements (i.e., if the gaps were formed across an entire width of the electrically conductive material), the longitudinally spaced segments would be electrically discontinuous segments. Additionally, one or more of the fusible elements may be configured to fuse or break down in the event that a fusing current is applied to the shield structure. Once a fusible element has fused, the electrical continuity between the two longitudinally spaced segments connected by the fusible element may be severed. As a result, the two longitudinally spaced segments may be discontinuous, thereby preventing a current or voltage signal from propagating along the longitudinal length of the shield structure between the two segments.

Any number of gaps may be formed as desired at a given longitudinally spaced location. Further, gaps may be formed with a wide variety of suitable dimensions (e.g., lengths across a widthwise direction of the shield structure, gap widths spanning along a longitudinal length of the shield structure, etc.) and/or at a wide variety of suitable angles. For example, gaps may be formed to span across a widthwise direction of the shield structure (e.g., partially across a width of the electrically conductive material, etc.) at an angle that is perpendicular to a longitudinal direction. As another example, gaps may be formed diagonally across a widthwise direction or at angles that are not perpendicular to the longitudinal direction. Gaps may also be formed with a wide variety of suitable shapes, such as rectangular shapes, shapes that include at least one curve or arc, and/or shapes that result in the gaps widening and/or tapering along a widthwise direction and/or a longitudinal direction.

The fusible element(s) formed at each longitudinally spaced location may have dimensions and are shapes defined by the one or more corresponding gaps at the longitudinally spaced location. Given the multitude of different gap dimensions that may be formed, a fusible element may also be formed with a wide variety of suitable lengths, widths, shapes, and/or other dimensions. Additionally, a fusible element may be formed with dimensions that facilitate the fusible element fusing or break down based upon a wide variety of current and/or other signals being present on, transmitted through, or introduced to the fusible element. For example, the fusible element may have a minimum fusing current between approximately 0.001 and approximately 0.500 amperes. Additionally, a fusible element may be configured to fuse or break down within a wide variety of suitable time frames. For example, a fusible element may have a maximum time period to break down or fusing that is equal to 0.434 divided by the minimum fusing current (in amperes) to the power or exponent 1.213. In various embodiments, the fusing or break down of a fusible element may be based at least in part upon the material utilized to form the fusible element, a cross-sectional area of the fusible element, a current present on the fusible element, and/or a period of time for which the current is present.

A wide variety of suitable methods or techniques may be utilized in order to form gaps or spaces. In certain embodiments, one or more suitable punches, blades, cutting implements, or other suitable cutting means may be utilized to form gaps or spaces. In other embodiments, one or more lasers may be utilized to form gaps or spaces. As desired, gaps or spaces may be formed in a single shield structure or concurrently in a plurality of shield structures. Additionally, in certain embodiments, a shield structure may be incorporated into a cable or formed into a cable component. As a result of forming gaps or spaces through both an electrically conductive layer and a base layer, a continuous shield structure may be formed in a relatively faster, more efficient, and/or cost-effective manner than conventional shield structures. For example, a shield structure may be formed at line speeds of between approximately ten (10) meters per minute and approximately 100 meters per minute. These increased processing speeds permit overall cost to be reduced. Additionally, these increased speeds permit easier incorporation of shield structures into cables in an in-line process (i.e., without taking up a shield structure between manufacture of the structure and cable assembly).

Additionally, as a result of forming continuous shield structures that include one or more fusible elements, a continuous shield structure may be provided that does not need to be grounded on either end. In the event that a potentially dangerous current or charge is present on the shield structure, one or more fusible elements may break down or fuse, thereby severing the electrical continuity of the shield structure. Accordingly, the fusible elements may limit or prevent damage to equipment connected to a cable incorporating the shield structure. In certain embodiments, use of fusible elements may also reduce or limit shock hazards resulting from potentially dangerous currents present on the shield structure.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Example Systems for Forming Shield Structures

FIGS. 1-4 are block diagrams of example systems 100, 200, 300, 400 that may be utilized to manufacture or form continuous shield structures, according to an illustrative embodiment of the disclosure. These example systems 100, 200, 300, 400 may be utilized to form a wide variety of suitable shield structures, such as the shield structures described in greater detail below with reference to FIGS. 5A-13. Additionally, various components or aspects of any one of the example systems may be substituted into one or more of the other example systems. Indeed, a wide variety of suitable systems and/or combinations of components may be utilized in order to manufacture continuous shield structures.

Turning first to FIG. 1, a first example system 100 for manufacturing, constructing, or otherwise forming continuous shield structures is illustrated. The system 100 may include a source 105 of electrically conductive material 107 and one or more sources 110, 115 of dielectric material 112, 117. A wide variety of suitable types of electrically conductive material 107 may be provided by source 105, such as a metallic foil material or a metallic braid material. Additionally, a wide variety of suitable types of dielectric material 112, 117 may be provided by sources 110, 115, such as suitable plastic and/or polymeric materials. In certain embodiments, the electrically conductive material 107 and the dielectric materials 112, 117 may be relatively thin, flat materials that extend in a longitudinal direction. These materials may have a wide variety of suitable thicknesses and widths. A few examples of suitable materials are described in greater detail below with reference to the example shield structures illustrated in FIGS. 5A-13. The sources 105, 110, 115 of material may be, for example, suitable bins or reels of material. In certain embodiments, each source of material may include a suitable payoff from which material may be fed downstream to other components of the system 100.

The electrically conductive material 107 and at least a base layer of dielectric material 112 may be fed through the system 100 to an accumulation point 120 at which they are joined together. In other words, the electrically conductive material 107 may be applied to or formed on a base layer of dielectric material 112. In certain embodiments, one or more suitable devices or components 125A, 125B may apply pressure to the electrically conductive material 107 and the base dielectric material 112 in order to bond or otherwise affix the two layers of material to one another. For example, one or more pressure rollers, spring-mounted rollers, or other suitable components may press the two layers of material together.

In certain embodiments, the base layer of dielectric material 112 may have a first width, and the electrically conductive material 107 may have a second width that is less than the first width. When the electrically conductive material 107 is formed on the base layer 112, the base layer 112 may extend beyond the electrically conductive material 107 along one or both edges in a width dimension. In certain embodiments, the electrically conductive material 107 may be approximately centered on the base layer 112 in a width dimension, and the base layer 112 may extend beyond the electrically conductive material 107 along both edges. In other embodiments, the base layer of dielectric material 112 and the electrically conductive material 107 may have widths that are approximately equal. In other words, the electrically conductive material 107 may span across the base layer of dielectric material 112 in a widthwise direction.

The base layer of dielectric material 112 may be positioned on one side of the electrically conductive material 107. As illustrated, the base layer 112 is positioned below or on a bottom side of the electrically conductive material 107; however, in other embodiments, the base layer 112 may be positioned above or on a top side of the electrically conductive material 107. In certain embodiments, an additional layer of dielectric material 117 may be positioned or situated on an opposite side of the electrically conductive material 107. In other words, the electrically conductive material 107 may be sandwiched between two layers 112, 117 of dielectric material. As shown in FIG. 1, an additional "sandwiching" layer of dielectric material 117 may be provided prior to the formation of spaces or gaps. In other embodiments, such as that illustrated in FIG. 2, an additional "sandwiching" layer of dielectric material 117 may be provided following the formation of spaces or gaps.

In certain embodiments, the electrically conductive material 107 may be adhered to the base layer of dielectric material 112 and, if provided, an additional "sandwiching" layer of dielectric material 117. A wide variety of suitable adhesives may be utilized to adhere layers together, such as for example, pressure sensitive adhesives, contact adhesives, hot melt adhesives, heat-sensitive adhesives, etc. In certain embodiments, one or more adhesive application components 130A, 130B may be configured to apply adhesive to the electrically conductive material 107 and/or to one or more layers of dielectric material 112 prior to the layers being brought into contact with one another. For example, one or more application components 130A, 130B may spray, wipe, or otherwise apply adhesive. In other embodiments, one or more layers of material (e.g., the electrically conductive material 107, etc.) may already include applied adhesive that is covered by one or more disposable layers, such as removable paper or film layers, and the one or more adhesive application components 130A, 1308 may be configured to remove the disposable layer(s). In yet other embodiments, the electrically conductive material 107 may be bonded to one or more layers of dielectric material 112 using other suitable techniques, such as mechanical fasteners, welding, heated fusion, etc.

As desired in certain embodiments, the electrically conductive material 107 may be sandwiched between two layers of dielectric material 112, 117, and the two layers of dielectric material 112, 117 may be adhered or otherwise bonded together along their edges (i.e., the widthwise edges that extend beyond the electrically conductive material 107). For example, the two layers of dielectric material 112, 117 may be bonded together using one or more suitable adhesives (e.g., pressure sensitive adhesives, etc.), ultrasonic welding, mechanical fasteners, and/or other suitable techniques.

Although the system 100 illustrates the provision of electrically conductive material 107 in the form of a tape layer, electrically conductive material may be provided on a base dielectric layer 112 utilizing a wide variety of other suitable equipment and/or processing techniques. In various example embodiments, electrically conductive material may be painted, printed, sprayed, extruded, or vapor deposited onto a base dielectric layer 112. For example, liquid metal may be painted, sprayed, extruded or otherwise deposited onto a base dielectric layer 112.

In certain embodiments, such as embodiments in which electrically conductive material 107 has a smaller width than a base dielectric layer 112, one or more strength members may additionally be incorporated into a shield structure. As shown in FIG. 1, one or more strength member sources 140A, 140B, such as one or more bins or reels that include respective payoffs, may be configured to supply strength members 142A, 142B that are incorporated into a shield structure, for example, at the accumulation point 120. A wide variety of suitable types of strength members 142A, 142B may be provided including, but not limited to, aramid fibers, strength yarns, threads, liquid crystal polymer ("LCP") strength members, nylon yarns, nylon strength members, highly-oriented polyethylene fibers, etc. In certain embodiments, each strength member 142A, 142B may be positioned on the base dielectric layer 112 such that it extends in a longitudinal direction parallel to the electrically conductive material 107. In other words, each strength member 142A, 142B may be positioned such that it longitudinally extends along widthwise portion(s) of the base dielectric layer 112 that overhang or extend beyond the electrically conductive material 107. In certain embodiments, a respective strength member 142A. 142B may be positioned on either side of the electrically conductive material 107. Additionally, in certain embodiments, one or more strength members 142A, 142B may be sandwiched between two layers of dielectric material 112, 117. As desired, one or more strength members 142A, 142B may be adhered, glued, mechanically fasted, or otherwise bonded or attached to one or more layers of dielectric material 112, 117. In other embodiments, the strength member(s) 142A, 142B may be held in place by pressure exerted by sandwiching layers of dielectric material 112, 117.

With continued reference to FIG. 1, once the electrically conductive material 107 has been formed on the base dielectric layer 112 (and once one or more optional layers or components have been incorporated), a plurality of longitudinally spaced gaps or holes may be formed through the combined electrically conductive material 107 and base dielectric layer 112 (hereinafter referred to as shield structure 147). A wide variety of suitable gap formation tools 145, equipment, and/or means may be utilized as desired. In certain embodiments, one or more suitable punches, punch presses, cutting blades, or other suitable components may be utilized to physically form gaps or holes. In other embodiments, one or more suitable lasers may be utilized to form or cut gaps or holes. Other suitable types of gap formation tools 145 may be utilized in other embodiments provided that the tools are capable of forming holes or openings through the electrically conductive and base dielectric layers.

In certain embodiments, a single gap formation tool 145 may be utilized. As a shield structure 147 is fed downstream through the system 100, the gap formation tool 145 may form gaps at different points along the longitudinal length of the shield structure 147. In other embodiments, a plurality of gap formation tools 145 may be utilized. In this regard, a plurality of gaps and/or different types of gaps may be formed in a shield structure 147. For example, in certain embodiments and explained in greater detail below with reference to FIG. 4, gaps may be formed in a plurality of shield structures in parallel. As another example, gaps may be simultaneously formed at multiple points along a longitudinal length of one or more shield structures. As yet another example, various gap formation tools 145 may form gaps or spaces having different configurations (i.e., different sizes, different angles, etc.). Additionally, in certain embodiments, a single gap may be formed at each of a plurality of spaced locations along a longitudinal length of the shield structure 147. In other embodiments, a plurality of gaps may be formed at one or more of a plurality of spaced locations along a longitudinal length of the shield structure 147. Indeed, a wide variety of different types of tooling and/or equipment configurations may be utilized in order to form desired gaps, holes, or openings.

A gap formation tool 145 may be configured to form one or more gaps having a wide variety of shapes, dimensions, and/or sizes. According to an aspect of the disclosure, one or more gaps may be formed with a suitable dimension (e.g., a length, etc.) that spans partially across a widthwise dimension of the electrically conductive layer 107 incorporated into a shield structure 147. As a result of forming one or more gaps at a given location along the longitudinal length of the shield structure 147, the electrically conductive layer 107 may be divided into one or more spaced segments, patches, or sections. Additionally, one or more fusible elements may span between each adjacent pair or set of segments or patches. The fusible elements may electrically connect the adjacent sets or pairs of longitudinally spaced segments of electrically conductive material. In certain embodiments, a single gap may be formed at a given longitudinally spaced location, and the gap may result in the removal of electrically conductive material such that one (e.g., a fusible element at or near one widthwise edge of the electrically conductive material) or a plurality (e.g., respective fusible elements at opposite widthwise edges of the electrically conductive material) of fusible elements are formed. In other embodiments, a plurality of gaps may be formed at a given longitudinally spaced location such that one or a plurality of fusible elements are formed between adjacent segments or patches.

A gap may also be formed with any suitable width or size along a longitudinal direction of a shield structure 147. The width or longitudinally extending size of a gap may define a spacing between two adjacent segments of electrically conductive material within the shield structure 147. In certain embodiments, the width of a gap may also define a longitudinal length of a fusible element. In other embodiments, a fusible element may be formed with a length that is longer than that of the gap width. For example, a fusible element may extend between two segments of electrically conductive material at an angle relative to a longitudinal direction. As another example, a fusible element may include one or more curves, arcs, or bends as it extends between two segments of electrically conductive material. Examples of suitable gap widths include, but are not limited to, widths of 0.01, 0.05, 0.1, 0.15, 0.2, 0.25, 0.3, 0.4, 0.5, 1.0, 1.5, 2.0, 2.5, 3.0, 3.5, 3.5, 4.0, 4.5, 5.0, 6.0, 7.0, 8.0, 9.0, 10, 12, 15, or 20 millimeters, widths included in a range between any two of the aforementioned values, or widths included in a range bounded on either a minimum or maximum end by one of the aforementioned values. In certain embodiments, a fusible element may span across a gap that is large enough to prevent current from arcing across the gap once the fusible element has fused or broken down.

A gap or a plurality of gaps may be formed at a wide variety of suitable angles relative to the longitudinal direction of a shield structure 147. For example, a gap may be formed at a perpendicular angle relative to the longitudinal direction. In other words, the gap may be formed directly across a width dimension of a shield structure 147. As another example, a gap may be formed at any suitable angle such that is extends diagonally across the width dimension of a shield structure 147. For example, a gap may be formed at an angle between zero degrees and between ninety degrees relative to the longitudinal direction of the shield structure, such as an angle of approximately 5, 10, 15, 20, 25, 30, 35, 40, 45, 50, 55, 60, 65, 70, 75, 80, or 85 degrees, or at any angle included in a range between two of the aforementioned values. In various embodiments, each of a plurality of gaps may be formed at approximately the same angle relative to the longitudinal direction or, alternatively, at least two gaps may be formed at different angles.

As desired in various embodiments, a wide variety of suitable spacings may exist between gaps (or longitudinally adjacent sets of gaps) along a longitudinal direction of a shield structure 147. In other words, spaced electrically conductive segments or patches of material formed between gaps and connected by fusible elements may have any suitable longitudinal lengths. In certain embodiments, the longitudinal length of each segment may be approximately equal. In other embodiments, at least two segments may have varying longitudinal lengths. In the event that segment lengths are varied, the length may vary in accordance with a predetermined pattern or, alternatively, at random. In various embodiments, the segments may have longitudinal lengths of about 0.03, 0.05, 0.1, 0.3, 0.5, 0.75, 1.0, 1.5, 2.0, 2.5, 3.0, 3.5, 4.0, 4.5, or 5.0 meters or in a range between any two of these values. As desired, the dimensions of the electrically conductive segments can be selected to provide electromagnetic shielding over a specific band of electromagnetic frequencies or above or below a designated frequency threshold. For example, in the event that the segments are approximately two meters in length or greater, a return loss spike for a twisted pair cable may be formed within the operating frequency of the cable. However, the amplitude of the return loss spike may satisfy electrical performance requirements for the cable (i.e., fall within acceptable limits), thereby permitting higher signal frequencies to be supported by the cable.

Additionally, each of the longitudinally spaced segments may have any suitable width. In certain embodiments, each segment may have equal or approximately equal widths. In other embodiments, at least two segments may have different widths. Further, in certain embodiments, one or more segments of the electrically conductive material 107 may have widths that span across or approximately across (e.g., with a narrow space of dielectric material present on one or both sides) the width of an underlying base layer 112. In other words, the longitudinally spaced segments may span across or substantially across the base layer 112 in a widthwise direction or dimension perpendicular to the longitudinal direction. In other embodiments, one or more segments may have widths that are less than that of the base dielectric layer 112. For example, the base layer 112 may extend beyond the electrically conductive material 107 at one or both widthwise edges. In yet other embodiments, one or more segments may have widths that are substantially smaller than that of the underlying base layer 112. For example, a shield structure may be formed with two or more parallel rows of longitudinally spaced segments of electrically conductive material 107, and the two or more rows may be spaced along a widthwise dimension of the base layer 112. Each of the one or more rows of longitudinally spaced segments may include respective fusible elements.

A gap or a plurality of gaps may also be formed with a wide variety of suitable shapes and/or other dimensions. For example, gaps may be formed with rectangular shapes, shapes that include at least one curve or arc, and/or shapes that result in the gaps widening and/or tapering along a widthwise and/or longitudinal direction. According to an aspect of the disclosure, the fusible element(s) formed at each longitudinally spaced location between adjacent segments of electrically conductive material 107 may have dimensions and are shapes defined by the one or more corresponding gaps at the longitudinally spaced location. Given the multitude of different gap dimensions that may be formed, a fusible element may also be formed with a wide variety of suitable lengths, widths, shapes, and/or other dimensions. A few example shapes and/or configurations of fusible elements are described in greater detail below with reference to FIGS. 5A-13L.

Additionally, a fusible element may be formed with a wide variety of suitable dimensions, such as any suitable lengths, widths, cross-sectional areas, and/or other dimensions. In certain embodiments, a length of a fusible element may correspond to or incorporate the sections of one or more tapered portions of spaced segments of electrically conductive material 107 that will fuse with a desired minimum fusing current. For example, gaps may be formed such that one or both segments included in an adjacent pair of spaced segments may taper as they approach one another. The tapering may result in progressively less electrically conductive material. The fusible element may begin at a point in which the electrically conductive material becomes small enough to fuse with a desired minimum fusing current. Accordingly, in certain embodiments, the fusible element may be formed as part of one or more spaced segments. For example, the fusible element may be formed at or proximate to a narrowest point of one or more tapering portions of spaced segments. In other embodiments, a fusible element may extend from the end of a narrowest point of a tapered portion of a spaced segment towards an adjacent spaced segment.

In other embodiments, one or more gaps may be formed in order to provide a separation distance between an adjacent pair of segments, and one or more fusible elements may extend across the separation distance. In certain embodiments, a length of a fusible element may be approximately equal to the longitudinal gap or spacing formed between two adjacent spaced segments. For example, a fusible element may extend across a gap in a longitudinal direction between two adjacent spaced segments. In yet other embodiments, a length of a fusible element may be greater than the longitudinal length of a gap or spacing formed between two adjacent spaced elements. For example, a fusible element may extend across a gap at an angle relative to the longitudinal direction, in a direction that includes one or more curves or arcuate portions, or in a fashion that includes one or more changes of directions. In certain embodiments, a longer length of a fusible element may increase the likelihood of the fusible element fusing in the event that a fusing current is applied. A longer length results in current applied to the shield structure 147 propagating over a longer distance, thereby enhancing likelihood of fusing or break down.

In certain embodiments, a minimum fusing current for a fusible element may be based at least in part on the cross-sectional area of the fusible element. The cross-sectional area of the fusible current may be based at least in part upon a width, thickness, and/or other dimensions of the fusible element. As desired, one or more dimensions of a fusible element may be selected and/or formed via gaps in order to result in the fusible element having a desired minimum fusing current. Further, the one or more dimensions of the fusible element may also be based at least in part upon the material utilized to form the fusible element. In certain embodiments, a fusible element may have a constant width, cross-sectional area, and/or other dimensions across its length. In other embodiments, a fusible element may have a width, thickness, and/or a cross-sectional area that is varied across its length. For example, a fusible element that is formed from parts of one or more tapering or narrowing portions of spaced segment may have a width that varies across its length (e.g., a width that narrows with a tapering section of a first segment and then widens with a tapering section of an adjacent second segment, etc.).

A fusible element may be formed or designed to have a wide variety of suitable minimum fusing currents. In certain embodiments, a fusible element may have a minimum fusing current between approximately 0.001 and approximately 0.500 amperes. In various embodiments, a fusible element may have a minimum fusing current of 0.001, 0.005, 0.010, 0.020, 0.030, 0.040, 0.050, 0.075, 0.10, 0.125, 0.15, 0.175, 0.20, 0.25, 0.30, 0.35, 0.40, 0.45, or 0.50 amperes, or a minimum fusing current included in a range between any two of the above values. Additionally, a fusible element may be configured to fuse or break down within a wide variety of suitable time frames. For example, a fusible element may have a maximum time period to break down or fusing defined by equation one (1) below:

$$T_F = 0.0434/(C_F^{1.213}) \quad (1)$$

where $T_F$ is the maximum time period until fusing or break down and CF is the minimum fusing current.

In various embodiments, the fusing or break down of a fusible element may be based at least in part upon several different factors including, but not limited to, the material(s) utilized to form the fusible element, a cross-sectional area of the fusible element, a current present on the fusible element, and/or a period of time for which the current is present. As desired, one or more materials utilized to form the electrically conductive layer 107 and one or more fusible elements and/or one or more dimensions of the fusible element (e.g., a width, a thickness, a cross-sectional area, etc.) may be selected in order to attain a desired minimum fusing current and/or maximum time until fusing.

Once longitudinally spaced gaps and/or combinations of gaps are formed in the shield structure 147, one or more respective fusible elements may span between or provide electrical continuity between each set of longitudinally adjacent spaced sections of electrically conductive material. A fusible element may be configured to fuse or break down in the event that a threshold current is present on, transmitted through, or introduced to the fusible element. Once the one or more fusible elements spanning between a set of adjacent spaced segments have fused or broken down, the electrical continuity between the segments may be severed, thereby preventing an electrical current from propagating longitudinally along the shield structure. As a result, the fusible elements may function as a safety mechanism for equipment connected to the cable 100 and/or may reduce or limit the shock hazard of the shield structure. Accordingly, a continuous shield layer 147 may be provided that does not need to be grounded on either end. As desired, the minimum fusing current of a fusible element may be based at least in part on equipment tolerances and/or safety standards.

As set forth above, the gap formation tool(s) 145 may be configured to form a wide variety of suitable gap configurations. Additionally, in certain embodiments, the gap formation tool(s) 145 and other components of the system 100 may be configured to operate at line speeds of at least approximately ten (10) meters per minute. For example, the system 100 may operate at line speeds between approximately 10 meters per minute and approximately 100 meters per minute. In various embodiments, the system 100 may operate at a line speed of approximately, 10, 20, 25, 30, 40, 50, 60, 70, 75, 80, 90, or 100 meters per minute, or at a line speed included in a range between two of the above values, or at a line speed included in a range that is bounded on either a minimum or maximum end by one of the above values. In certain embodiments, one or more accumulators 150A, 150B may be incorporated into the system 100. For example, one or more accumulators 150A. 150B may optionally be positioned upstream and/or downstream of the gap formation tool(s) 145. The accumulator(s) 150A, 150B may be configured to temporarily collect the shield structure 147 as it is fed downstream through the gap formation tool(s) 145. In this regard, the shield structure 147 may be momentarily slowed or stopped in order to more accurately or precisely form each gap.

With continued reference to FIG. 1, once gaps or spaces are formed in the shield structure 147, the shield structure 147 may be collected for subsequent use at a suitable take-up device 155, such as a suitable reel or collection bin. In this regard, the shield structure 147 may be subsequently provided to a system that assembles a cable or that forms the shield structure 147 into a suitable component for incorporation into a cable. In other embodiments, such as that illustrated in FIG. 2, a shield structure 147 may be fed directly into a cable assembly system or process in an in-line or continuous manner. For example, a shield structure 147 may be incorporated into a twisted pair communication cable in an in-line manner. In yet other embodiments, the shield structure 147 may be formed into a suitable cable component, such as a suitable twisted pair separator prior to being taken up for subsequent incorporation into a cable.

A wide variety of other components and/or devices may be incorporated into the system 100 as desired in various embodiments. For example, any number of rollers and/or dancers, such as the illustrated rollers 160, may be utilized to pull or otherwise advance materials (e.g., electrically conductive material 107, dielectric layers 112, 117, strength members, the shield structure 147, etc.) through the system 100. Any number of motors or other drive components may be utilized to power various components of the system 100 and/or to control line speed. As desired, the motors may be collectively or independently controlled by any number of suitable computing and/or control devices. In certain embodiments, the system 100 may additionally include one or more printing components or devices that are configure to print alphanumeric characters (e.g., text, a company name, etc.) and/or logos onto a shield structure 147. As desired, one or more optical recognition components may be utilized to identify the gaps or spaces in the shield structure 147 in order to facilitate printing between the gaps.

Figure 2:
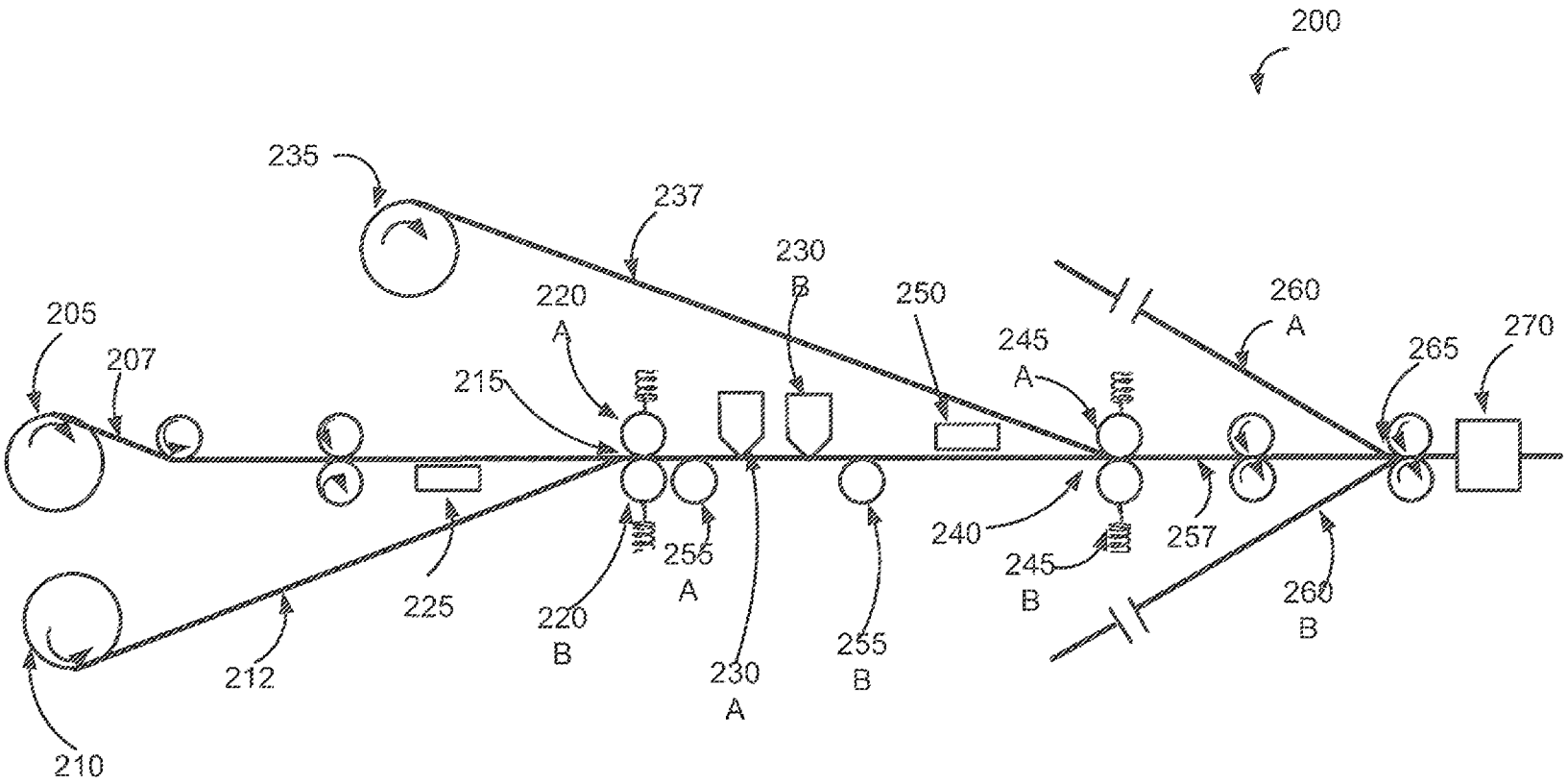

FIG. 2 illustrates another example system 200 that may be utilized to manufacture, construct, or otherwise form continuous shield structures. The system 200 may include components that are similar to those described above with reference to the system 100 of FIG. 1. For example, the system 200 may include a source 205 of electrically conductive material 207 and a source 210 of a base dielectric material 212. The electrically conductive material 207 and the base dielectric material 212 may be fed to an accumulation point 215 at which they are joined together. As desired, one or more pressure devices 220A, 220B may press the electrically conductive material 207 and the base dielectric material 212 together. Additionally, one or more suitable devices 225 may apply adhesive or remove a disposable layer prior to the electrically conductive material 207 and the base dielectric material 212 being pressed together. Other components may be added at the accumulation point 215 as desired, such as one or more strength members.

However, in contrast to the system 100 of FIG. 1, the system 200 of FIG. 2 illustrates a single dielectric layer 212 being combined with electrically conductive material 207 at the accumulation point 215. Accordingly, when gaps or spaces are formed via one or more suitable gap formation devices 230A. 230B, the gaps or spaces are only formed through the electrically conductive material 207 and the base dielectric layer 212. A "sandwiching" layer of dielectric material may then be added to the shield structure following the formation of gaps or spaces. As a result of the "sandwiching" layer not including gaps, the "sandwiching" layer may provide additional strength or support to the shield structure. An example of such a shield structure is described in greater detail below with reference to FIG. 9.

As shown in FIG. 2, a second source 235 of dielectric material 237 may be provided. The second layer of dielectric material 237 may be fed to a second accumulation point 240 at which it is joined or bonded to the shield structure following the formation of gaps through the electrically conductive material 207 and the base dielectric layer 212. As shown, one or more pressure devices 245A, 245B may press the layers of material together when they are combined. Additionally, one or more suitable devices 250 may apply adhesive or remove a disposable layer prior to the layers of material being pressed together. For example, adhesive may be applied to the second layer of dielectric material 237 and/or to the structure formed from the electrically conductive material 207 and the base dielectric layer 212.

With continued reference to FIG. 2, a plurality of longitudinally spaced gap formation tools 230A, 230B are illustrated. As desired, one or more accumulators 255A, 255B may optionally be positioned upstream and/or downstream of the combined gap formation tools 230A, 230B or alternatively, individual gap formation tools or various groupings of gap formation tools. In certain embodiments, the plurality of gap formation tools permits a plurality of gaps or holes to be formed concurrently or relatively close in time. For example, a first gap formation tool 230A may form a gap (or a plurality of gaps) at a first location along a longitudinal length of a shield structure while a second gap formation tool 230B forms a gap (or a plurality of gaps) at a second location along the longitudinal length. In certain embodiments, the use of a plurality of longitudinally spaced gap formation tools may permit overall line speeds to be increased. Additionally or alternatively, in certain embodiments, such a configuration may permit the formation of gaps or spaces having different dimensions (e.g., different sizes, angles, shapes, etc.). For example, a first gap formation tool 230A may be configured to form a gap at a first angle relative to the longitudinal direction of a shield structure while a second gap formation tool 230B may be configured to form a gap at a second angle relative to the longitudinal direction of the shield structure. As desired, any number of gap formation tools and configurations may be utilized to form desired gap, fusible element, and electrically conductive patch configurations. In other embodiments, a single gap formation tool, such as a single laser, may be configured to form various gaps having different dimensions.

With continued reference to FIG. 2, following the formation of a shield structure (hereinafter referred to as shield structure 257), the shield structure 257 may be incorporated into a cable in an in-line or continuous process. In other words, rather than taking up the shield structure 257 for subsequent use, the shield structure 257 may be fed directly into a cable assembly or cable formation process. As shown, the shield structure 257 may be fed along with any number of other cable components 260A, 260B, such as a plurality of twisted pairs of individually insulated conductors, to an assembly point 265. The shield structure 257 may then be incorporated into the cable prior to the formation of an outer jacket. As shown, the shield structure 257 may be passed through one or more dies 270 that are configured to wrap or fold the shield structure 257 about one or more cable components 260A, 260B. In this regard, a shield layer (e.g., an overall shield layer, an individual shield layer, etc.) may be formed around one or more twisted pairs of conductors. In other embodiments, the shield structure 257 may be passed through one or more dies (or other components) configured to form the shield structure 257 into a separator that may be positioned between two or more twisted pairs of conductors. Other suitable components and/or devices may be utilized to incorporate the shield structure 257 into a cable. The illustrated components are provided by way of example only.

As desired, one or more components of the system 200 may be synchronized with one or more components of a cable assembly system. For example, a line speed of a system 200 that assembles or manufactures a shield structure may controlled such that it is approximately equal to the line speed of a system 200 that assembles cable. In this regard, a shield structure may be manufactured and fed into a cable assembly process in a continuous manner. The systems and methods described herein for manufacturing shield structures permit line speeds that are greater than those of conventional processes utilized to form certain shield structures (e.g., discontinuous shield structures, etc.). These increased line speeds may facilitate the synchronization of a shield structure manufacturing process and a cable assembly process.

Figure 3:
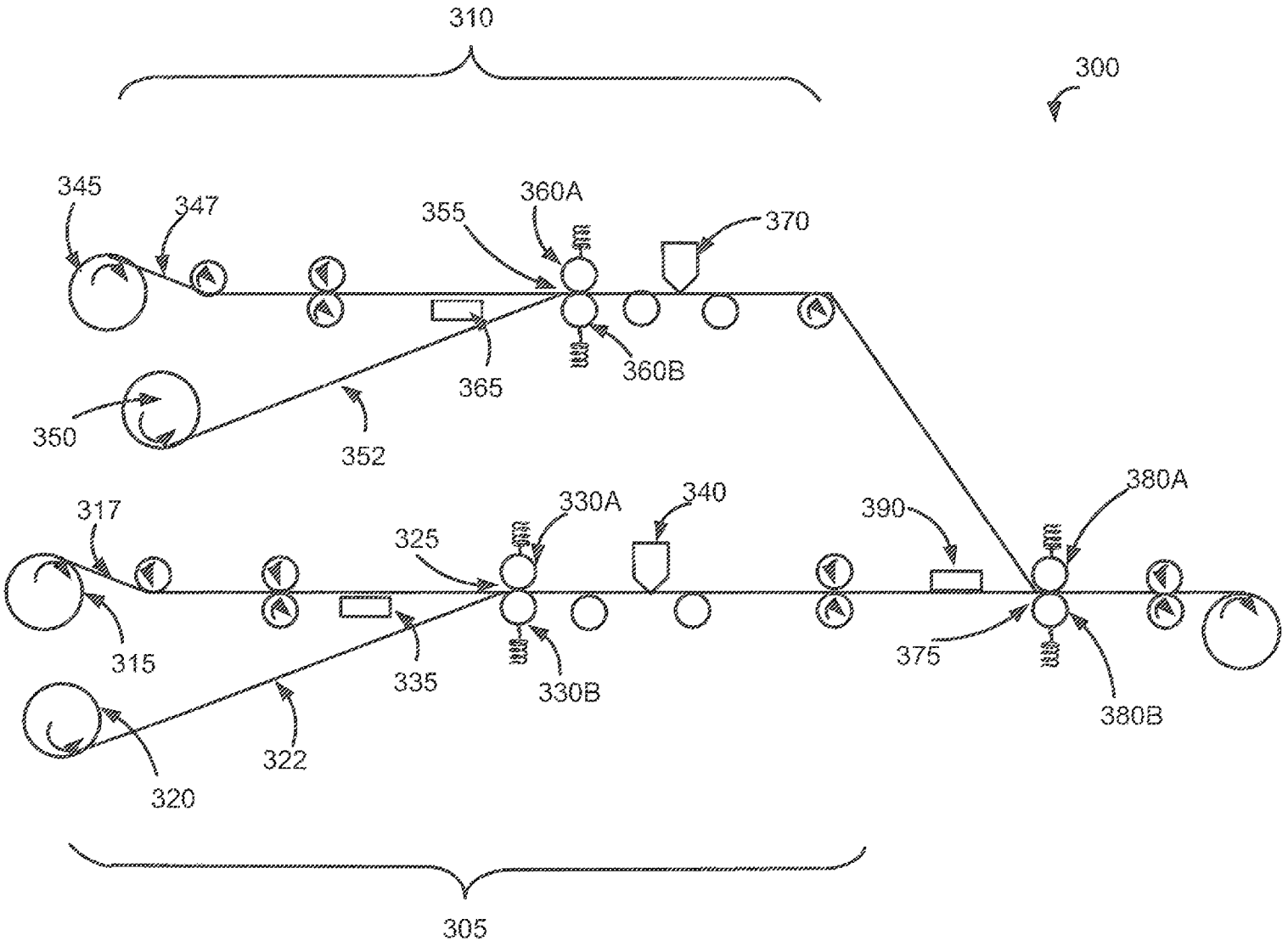

Turning now to FIG. 3, another example system 300 that may be utilized to manufacture, construct, or otherwise form continuous shield structures is illustrated. The system 300 may include components that are similar to those described above with reference to the systems 100, 200 of FIGS. 1-2. However, in the system 300 of FIG. 3, a plurality of separate shield structures may be produced in parallel and then combined together in order to form a final structure. For example, two separate shield structures that each include electrically conductive material formed on a base dielectric layer may be formed. The two structures may then be bonded together. As desired, the respective gaps or holes in each shield structure may be longitudinally offset from one another. In this regard, a final shield structure may be formed in which the gaps or holes formed through a first electrically conductive layer are covered by electrically conductive material included in a second electrically conductive layer. An example of such a shield structure is described in greater detail below with reference to FIGS. 11A-B.

With reference to FIG. 3, the system 300 may include a first subsystem 305 configured to produce a first shield structure and a second subsystem 310 configured to produce a second shield structure. The first subsystem 305 may include a source 315 of electrically conductive material 317 and a source 320 of a base dielectric material 322. The electrically conductive material 317 and the base dielectric material 322 may be fed to an accumulation point 325 at which they are joined together. As desired, one or more pressure devices 330A, 330B may press the electrically conductive material 317 and the base dielectric material 322 together. Additionally, one or more suitable devices 335 may apply adhesive or remove a disposable layer prior to the electrically conductive material 317 and the base dielectric material 322 being pressed together. Other components may be added at the accumulation point 325 as desired, such as one or more strength members. Longitudinally spaced gaps or holes may then be formed in the combined electrically conductive material 317 and base dielectric material 322 by one or more gap formation tools 340.

Similarly, the second subsystem 310 may include a source 345 of electrically conductive material 347 and a source 350 of a base dielectric material 355. The electrically conductive material 347 and the base dielectric material 352 may be fed to an accumulation point 355 at which they are joined together. As desired, one or more pressure devices 360A, 360B may press the electrically conductive material 347 and the base dielectric material 352 together. Additionally, one or more suitable devices 365 may apply adhesive or remove a disposable layer prior to the electrically conductive material 347 and the base dielectric material 352 being pressed together. Other components may be added at the accumulation point 355 as desired, such as one or more strength members. Longitudinally spaced gaps or holes may then be formed in the combined electrically conductive material 347 and base dielectric material 352 by one or more gap formation tools 370.

The outputs of the first subsystem 305 and the second subsystem 310 may be fed downstream to an accumulation point 375 at which they are joined together. In this regard, an overall shield structure may be formed that includes a plurality of dielectric layers and a plurality of layers of electrically conductive material. As desired, one or more pressure devices 380A, 380B may press the two substructures together. Additionally, one or more suitable devices 355 may apply adhesive or remove a disposable layer prior to the two substructures being pressed together. Alternatively, the two substructures may be bonded together utilizing other suitable components and/or techniques, such as mechanical fasteners or ultrasonic welding. Additionally, other components may be added at the accumulation point 375 as desired, such as one or more strength members. Following formation of the overall shield structure, the structure may be taken up for subsequent incorporation into a cable as illustrated in FIG. 3. Alternatively, in other embodiments, the overall shield structure may be incorporated into a cable in an in-line process or formed into a suitable cable component, such as a separator component.

In certain embodiments, the gaps or holes formed in a first substructure may be longitudinally offset from the gaps or holes formed in a second substructure when the overall shield structure is formed. In other words, electrically conductive material included in the second substructure may cover any gaps or spaces formed through the electrically conductive material of the second substructure. In the event that electrical signals leak through one of the substructures, the other substructure may perform a shielding function. The presence of multiple layers of electrically conductive material may further provide enhanced shielding relative to shields with a single layer of electrically conductive material. In certain embodiments, multiple layers of electrically conductive material may also contribute to improved cable burn performance. Although the system 300 of FIG. 3 illustrates the formation of a shield structure that includes two dielectric layers and two electrically conductive layers, any number of layers may be incorporated into a shield structure as desired in various embodiments.

Figure 4:
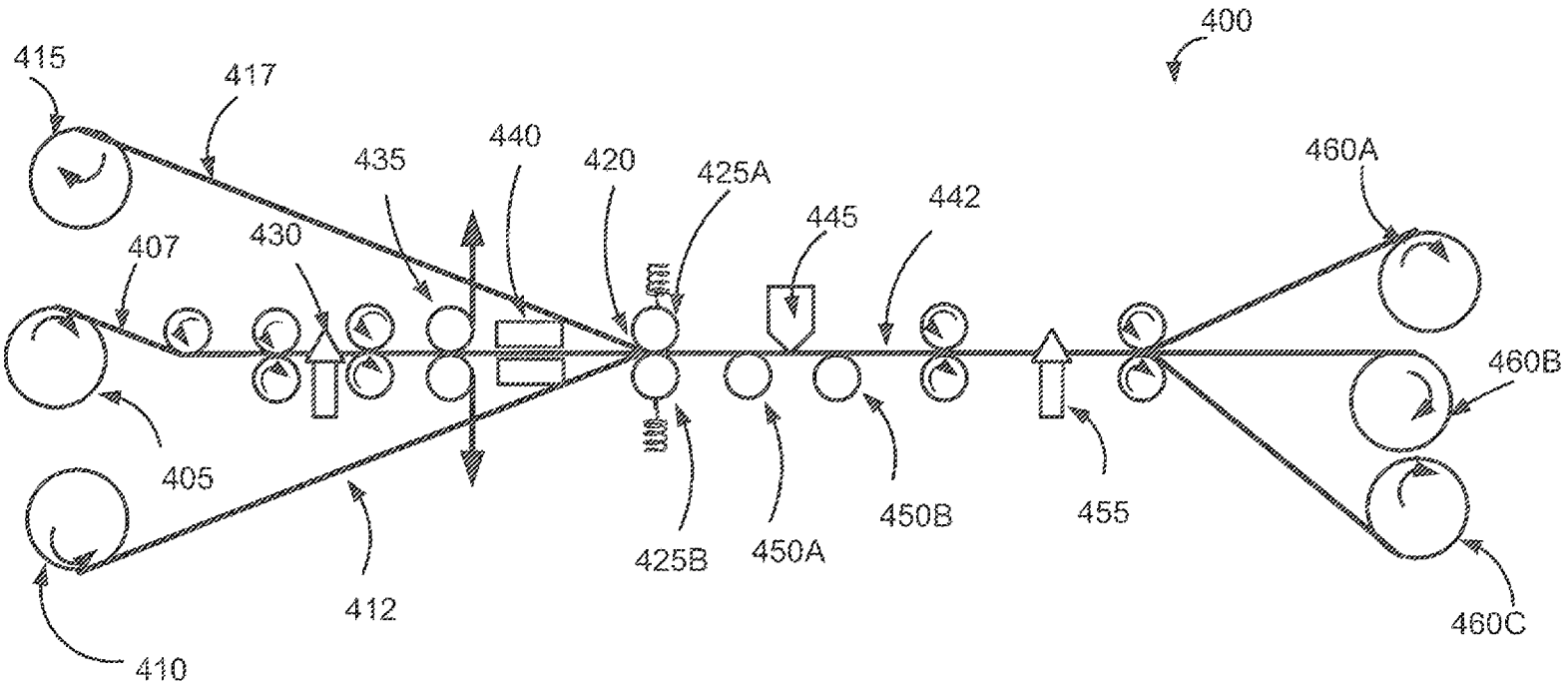

FIG. 4 illustrates another example system 400 that may be utilized to manufacture, construct, or otherwise form continuous shield structures. The system 400 may include components that are similar to those described above with reference to the systems 100, 200, 300 of FIGS. 1-3. However, in the system 400 of FIG. 4, a plurality of continuous shield structures may be manufactured in parallel utilizing shared dielectric material that is subsequently cut or slit into individual shield structures.

The system 400 may include one or more sources 405 of electrically conductive material 407 and one or more sources of dielectric material, such as a source 410 of a base dielectric material 412 and an optional source 415 of a "sandwiching" layer of dielectric material 417. The electrically conductive material 407 and the layer(s) 412, 417 of dielectric material may be fed to an accumulation point 420 at which they are joined together. As desired, one or more pressure devices 4250A, 425B may press the electrically conductive material 407 and the layer(s) 412, 417 of dielectric material together.

In contrast to the systems 100, 200, 300 of FIGS. 1-3, the electrically conductive material 407 may be cut or slit in the system 400 of FIG. 4 prior to being fed to the accumulation point 420. In other words, a single source or layer of electrically conductive material 407 may be cut into a plurality of longitudinally extending strips that may be joined to or otherwise formed on the based dielectric layer 412. An example of a base dielectric layer 412 on which a plurality of longitudinally extending strips of electrically conductive material have been formed in described in greater detail below with reference to FIG. 12. According to an aspect of the disclosure, each of the strips of electrically conductive material 407 may extend along a longitudinal length of the base dielectric layer 412 in parallel to one another. Additionally, adjacent strips of electrically conductive material 407 may be spaced apart from one another along a widthwise dimension of the base dielectric layer 412. The spacing may permit respective gaps or holes to be formed partially across a widthwise dimension and through each of the strips of electrically conductive material 407. Additionally, the spacing may facilitate subsequent slitting of the base dielectric layer 412 in order to form a plurality of individual continuous shield structures following the formation of gaps or holes.

With reference to FIG. 4, one or more cutting or slitting tools 430 may be configured to slit or cut the electrically conductive material 407 into a plurality of longitudinally extending strips. Examples of suitable cutting tools 430 include, but are not limited to, blades, knives, or other cutting implements configured to form a longitudinally extending cut through the electrically conductive material. Additionally, in certain embodiments, one or more scrap removal devices 435, such as scrap removal rollers and/or a vacuum system, may be configured to remove scrap electrically conductive material (e.g., scraps formed during cutting or slitting) and/or other debris prior to the strips of electrically conductive material 407 being formed on the base dielectric material 412. Additionally, one or more suitable devices 440 may apply adhesive or remove a disposable layer prior to the electrically conductive material 407 and the base dielectric material 412 being pressed together. Other components may be added at the accumulation point 420 as desired, such as one or more strength members.

As an alternative to cutting or slitting the electrically conductive material 407, in other embodiments, a plurality of sources of electrically conductive material may be provided. Each source may provide electrically conductive material that is fed to the accumulation point to be joined with the base dielectric layer. In yet other embodiments, other suitable techniques may be utilized to form a plurality of longitudinally extending parallel layers of electrically conductive material on a base dielectric layer. For example, a plurality of electrically conductive layers may be formed in parallel utilizing electrically conductive paint, extrusion, or vapor deposition.

As desired in various embodiments, any number of strips of electrically conductive material may be formed or otherwise provided. For example, between approximately two and approximately ten strips of electrically conductive material may be formed. In various embodiments, approximately 2, 3, 4, 5, 6, 7, 8, 9, 10, or any number of strips included in a range between two of the previous values may be provided. In the example system 400 illustrated in FIG. 4, three strips of electrically conductive material are formed. As desired in various embodiments, each strip may be formed with any suitable width. In certain embodiments, the width may be determined based at least in part on the desired application of a shielding structure. For example, if a shield structure is utilized to form a shield around one or more transmission media, the width may correspond to a desired circumference of the shield layer to be formed. Additionally, in certain embodiments, each strip may be formed with widths that are approximately equal. In other embodiments, at least two strips may be formed with different widths. For example, a first strip may be incorporated into a shield structure that is utilized for an individual twisted pair shield while a second wider strip is incorporated into a shield structure that is utilized for a shield formed around a plurality of twisted pairs (e.g., an overall shield). Indeed, a wide variety of suitable configurations of strips and/or strip dimensions may be utilized.

With continued reference to FIG. 4, once the plurality of strips of electrically conductive material are formed on the base dielectric layer 412 or, in certain embodiments, between two layers 412, 417 of dielectric material, the combined structure (hereinafter referred to as shield structure 442) may be fed to one or more gap formation tools 445. The gap formation tool(s) 445 may be configured to form longitudinally spaced gaps or holes in the shield structure 442. Respective gaps or holes may be formed through each of the strips of electrically conductive material and any dielectric layers included in the shield structure 442. In certain embodiments, a single gap formation tool 445 may be utilized to form respective gaps or spaces associated with each strip of electrically conductive material. For example, a single punch or other suitable device may form gaps through each electrically conductive strip. As desired, the single punch may include a plurality of punching prongs that are spaced from each other in a widthwise dimension in order to form a plurality of gaps that are spaced in the widthwise dimension and each associated with a respective electrically conductive strip. In other embodiments, a plurality of gap formation tools 445, such as a respective tool or group of tools associated with each electrically conductive strip, may be utilized. Indeed, a wide variety of different types and configurations of tooling may be utilized as desired in various embodiments. Additionally, as desired, any number of accumulators 450A. 450B may be utilized in order to momentarily stop or otherwise control the line speed of the shield structure 442 to facilitate formation of gaps or holes.

Following the formation of gaps or holes in the shield structure 442, the shield structure 442 may be fed to one or more suitable cutting or slitting devices 455 configured to cut the shield structure 442 into a plurality of separate structures. In certain embodiments, the shield structure 442 may be cut along its longitudinal length between the parallel strips of electrically conductive material. In other words, the base dielectric layer 412 of the shield structure 442 may be slit along one or more longitudinally extending lines that are situated between strips of electrically conductive material. In this regard, a plurality of individual shield structures may be manufactured concurrently and then separated from one another after the formation of gaps or holes (and, in certain embodiments, after the incorporation of other elements, such as a "sandwiching" layer added after the formation of gaps). As shown in FIG. 4, once the shield structure 442 has been slit, each of the individual shield structures may be provided to respective take-ups 460A, 460B, 460C for subsequent use. In other embodiments, one or more of the individual shield structures may be incorporated into a cable in an in-line or continuous manner, as described above with reference to FIG. 2. In yet other embodiments, one or more of the individual shield structures may be formed into a cable component for subsequent incorporation into a cable.

The systems 100, 200, 300, 400 described above with reference to FIGS. 1-4 are provided by way of example only. As desired, more or less components may be incorporated into any of the systems. Additionally, various systems may include any suitable combinations of components that are taken from any number of the systems 100, 200, 300, 400 described in order to produce desired shield structures. The described system are only intended to discuss various types of shield structures and associated features for these structures.

Example Continuous Shield Structures

According to an aspect of the disclosure, continuous shield structures may be formed that include longitudinally spaced gaps or spaces through both a layer of electrically conductive material and a base layer of dielectric material. A wide variety of different types of continuous shield structures may be manufactured or formed as desired. For example, different types of continuous shield structures may be formed by each of the systems 100, 200, 300, 400 described above with reference to FIGS. 1-4. A few example structures will now be described with reference to FIGS. 5A-13, which illustrate top level and cross-sectional views of example continuous shield structures that may be incorporated into cables.

Figure 5A:
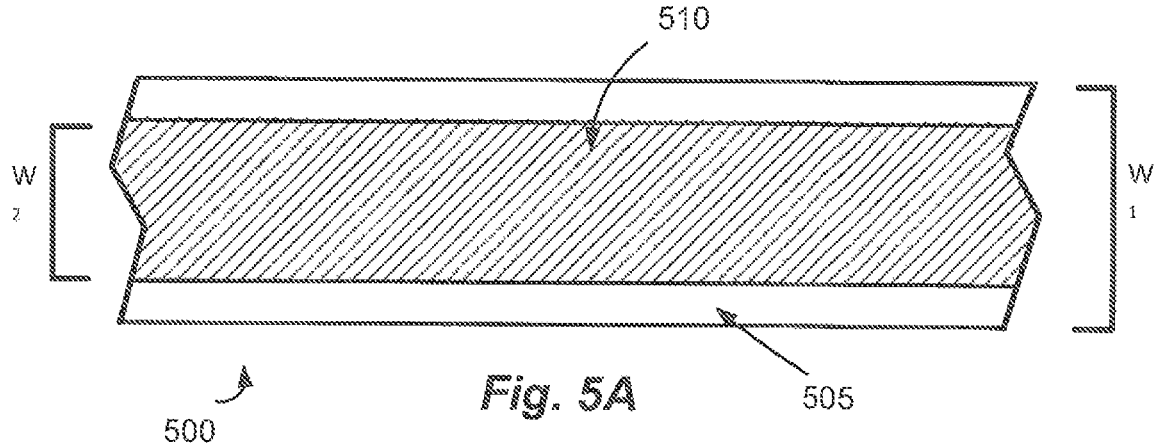
FIGS. 5A-13L are top level and cross-sectional views of example continuous shield structures that may be incorporated into cables, according to example illustrative embodiments of the disclosure.
Figure 5B:
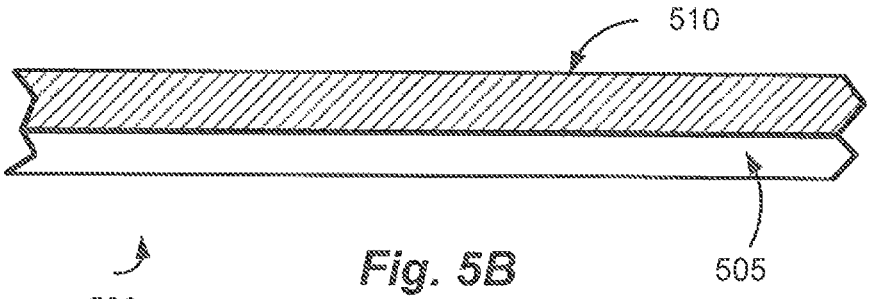

FIGS. 5A and 5B respectively illustrate a top level and a cross-sectional view of a continuous shield structure 500 in which a layer of electrically conductive material 510 has been formed on a base dielectric layer 505. However, gaps or spaces have not yet been formed through the electrically conductive material 510 and the dielectric layer 505. As shown, both the electrically conductive material 510 and the dielectric layer 505 may extend along a longitudinally direction. Additionally, each layer of material may have a respective width along a width dimension that is perpendicular to the longitudinal direction. For example, the base dielectric layer 505 may have a first width "$W_1$", and the electrically conductive material 510 may have a second width "$W_2$" that is less than the first width. Accordingly, when the electrically conductive material 510 is formed on the dielectric layer 505, the dielectric layer 505 may extend beyond the electrically conductive material 510 along one or both widthwise edges. As shown, the dielectric layer 505 extends beyond the electrically conductive material 510 along both widthwise edges. For example, the electrically conductive material 510 may be approximately centered on the dielectric layer 505 along the width dimension (i.e., each layer may have a common center line along the width dimension). As a result, when gaps or spaces are formed partially across a width dimension of the electrically conductive material 510, the overhanding or extending portions of the dielectric layer 505 may provide additional support and longitudinal continuity to the shield structure 500. In other embodiments, the base dielectric layer 505 and the electrically conductive material 510 may have widths ("$W_1$" and "$W_2$") that are approximately equal. When gaps or spaces are formed partially across a width dimension of the electrically conductive material 510, the unpunched portions of the electrically conductive material 510 and the dielectric layer 505 may provide support to the shield structure 500.

As desired, the base dielectric layer 505 may be formed from or formed substantially from one or more dielectric materials. A wide variety of suitable dielectric materials may be utilized including, but not limited to, paper, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, polytetrafluoroethylene, ethylene tetrafluoroethylene ("ETFE"), ethylene chlorotrifluoroethylene ("ECTFE"), etc.), one or more polyesters, polyimide, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or any other suitable material or combination of materials. As desired, one or more foamed materials may be utilized to form the first portion. Indeed, the first portion may be filled, unfilled, foamed, un-foamed, homogeneous, or inhomogeneous and may or may not include one or more additives (e.g., flame retardant and/or smoke suppressant materials).

The base dielectric layer 505 may also be formed with a wide variety of suitable dimensions. For example, the base dielectric layer 505 may have any suitable width "$W_1$". In certain embodiments, the width "$W_1$" may be determined based at least in part upon a desired cable component (e.g., a shield, a separator, etc.) to be formed from a shield structure. In other embodiments, the width "$W_1$" may be determined based at least in part upon a desired number of shield structures to be formed utilizing a single base dielectric layer 505. In certain example embodiments, the base dielectric layer 505 may have a width "$W_1$" between approximately five (5) mm and approximately thirty (30) mm. For example, the base dielectric layer 505 may have a width of approximately 5, 10, 15, 20, 25, or 30 mm, a width included in a range between two of the above values, or a width included in a range that is bounded at either a minimum or maximum end by one of the above values. Additionally, the base dielectric layer 505 may be formed with any suitable thickness. For example, the base dielectric layer 505 may have a thickness between approximately 10 micrometers (μm) and approximately 75 μm.

Additionally, the electrically conductive material 510 may be formed with a wide variety of suitable constructions and/or dimensions. For example, the electrically conductive material 510 may have any suitable width "$W_2$". In certain embodiments, the width "$W_2$" may be determined based at least in part upon a desired cable component (e.g., a shield, a separator, etc.) to be formed from a shield structure. In various example embodiments, the electrically conductive material 510 may have a width "$W_2$" between approximately 3 mm and approximately 25 mm or between approximately 3 mm and approximately 30 mm. For example, the electrically conductive material 510 may have a width of approximately 3, 5, 10, 12, 15, 18, 20, 22, 25, or 30 mm, a width included in a range between two of the above values, or a width included in a range that is bounded at either a minimum or maximum end by one of the above values. Additionally, the electrically conductive material 510 may be formed with any suitable thickness. For example, the electrically conductive material 510 may have a thickness between approximately 12.7 microns (0.5 mils) and approximately 76.2 microns (3.0 mils), such as a thickness between approximately 25.4 microns (1.0 mils) and approximately 76.2 microns (3.0 mils). In some applications, cable signal performance may benefit from a thickness that is greater than about 50.8 microns (2 mils). A greater thickness may limit negative insertion loss characteristics.

The electrically conductive material 510 may also be formed from a wide variety of suitable materials and/or combinations of materials. Examples of suitable electrically conductive materials include, but are not limited to, metallic materials (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. In certain embodiments, the electrically conductive material 510 may be formed as a foil layer, such as a metallic foil layer. In other embodiments, the electrically conductive material 510 may be formed as a metallic screen. In yet other embodiments, electrically conductive material 510 may be extruded, sprayed, or otherwise deposited on the base dielectric layer 505.

Figure 5C:
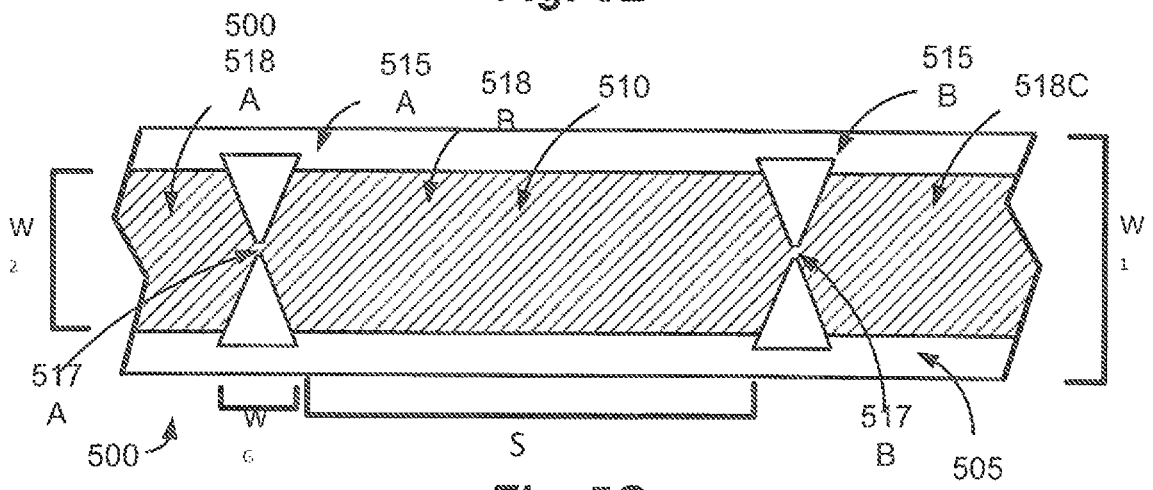
Figure 5D:
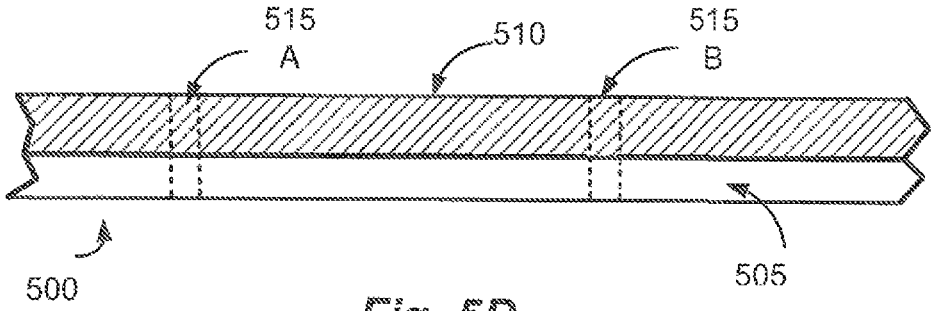

FIGS. 5C and 5D respectively illustrate the continuous shield structure 500 following the formation of longitudinally spaced gaps or holes 515A. 515B through the electrically conductive material 510 and the base dielectric layer 505. As shown, a plurality of gaps (i.e., the illustrated two gaps) may be formed at each longitudinally spaced location. In other embodiments, such as the embodiment shown in FIG. 6A, a single gap may be formed at each longitudinally spaced location. Additionally, according to an aspect of the disclosure, each gap 515A, 515B may have a length that extends partially across the width dimension of the shield structure 500. As a result, the gap(s) at each location may result in the formation of one or more fusible elements 517A, 517B. Each fusible element 517A, 517B may longitudinally extend between a respective set of longitudinally adjacent electrically conductive segments that are defined by the gaps 515A, 515B. For example, a first fusible element 517A may extend between a first segment 518A and a second segment 518B of electrically conductive material, and a second fusible element 517B may extend between the second segment 518B and a third segment 518C of electrically conductive material.

The gaps 515A, 515B may be formed with a wide variety of suitable shapes, sizes, and/or other dimensions. As shown in FIG. 5C, the gaps 515A, 515B may each be formed with a shape that results in a width of one or more electrically conductive segments being tapered along a longitudinal length of the shield structure 500. For example, the gaps 515A, 515B may be formed with a triangular shape or any other suitable shape that includes one or more tapering edges. In certain embodiments, a gap (generally referred to as gap 515) may taper along a widthwise direction or dimension of the shield structure 500, thereby resulting in the formation of one or more electrically conductive segments 518A, 518B that taper along a longitudinal direction. In other embodiments, such as the embodiment illustrated in FIG. 13C, a gap 515 may taper along both a widthwise and a longitudinal direction.

Each gap 515A, 515B may also be formed with any suitable width "$W_G$", which defines the spacing between adjacent electrically conductive patches and/or a longitudinal length of a fusible element. A few example gap widths are described in greater detail above with reference to FIG. 1. Additionally, in certain embodiments, a gap may be formed with a constant width as it extends partially across the electrically conductive material 510. As shown in FIG. 5C, in other embodiments, the width of a gap may be tapered or otherwise varied as the gap extends partially across the electrically conductive material 510.

Additionally, as described in greater detail above with reference to FIG. 1, a wide variety of suitable distances may be present between gaps along a longitudinal direction of the shield structure 500. For example, any suitable spacing "S" may be present between the gaps 515A, 515B illustrated in FIGS. 5C and 5D. The spacing may define the sizes of electrically conductive segments or patches of material included in the shield structure 500 and electrically connected to one another via fusible elements.

Figure 6A:
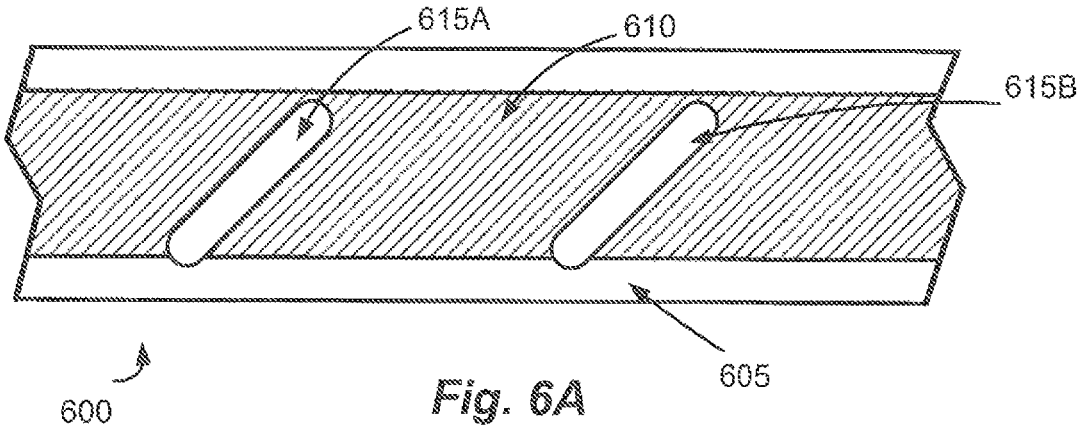
Figure 6B:
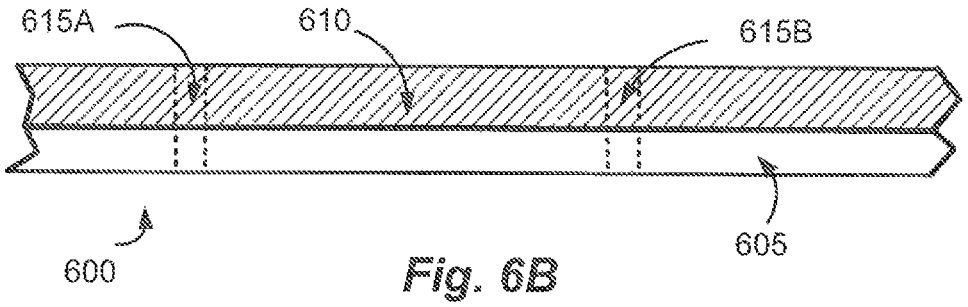

FIGS. 6A and 6B respectively illustrate top level and cross-sectional views of a continuous shield structure 600 in which gaps or holes are formed at an angle that is not perpendicular to the longitudinal direction of the structure 600. The shield structure 600 may include a base dielectric layer 605, and electrically conductive material 610 may be formed on the base dielectric layer 605. Additionally, longitudinally spaced gaps or holes 615A, 6158 may be formed through both the electrically conductive material 610 and the dielectric layer 605. Each gap 615A, 615B may extend partially across a width dimension of the electrically conductive material 610, thereby facilitating the formation of one or more fusible elements that longitudinally extend between longitudinally adjacent segments of electrically conductive material defined by the gaps 615A, 615B. As shown, each gap 615A, 615B may extend from a first widthwise edge of the electrically conductive material 610 towards an opposite widthwise edge, and a fusible element may be formed at or near the opposite widthwise edge. In other embodiments, a gap may be positioned between opposite widthwise edges such that fusible elements are formed at or near each widthwise edge. In other embodiments, a gap may include a plurality of components or each gap may be formed as a plurality of gaps such that one or more fusible elements are positioned between the two widthwise edges of the electrically conductive material 610.

As shown, the gaps 615A, 615B may be formed at an acute angle relative to the longitudinal direction. As desired, gaps 615A, 615B may be formed at any suitable angle, such as an angle of approximately 5, 10, 15, 20, 25, 30, 35, 40, 45, 50, 55, 60, 65, 70, 75, 80, or 85 degrees, or at any angle included in a range between two of the aforementioned values. In certain embodiments, the acute angle may enhance electrically conductive patch-to-substrate adhesion. Additionally, the acute angle may facilitate the covering of opposing isolating spaces or gaps when a cable component, such as a shield layer, is formed from the structure 600. In certain embodiments, benefit may be achieved when the acute angle is about 45 degrees or less. In other embodiments, benefit may be achieved when the acute angle is about 35 degrees or less, about 30 degrees or less, about 25 degrees or less, about 20 degrees or less, or about 15 degrees or less. In other embodiments, benefit may be achieved when the acute angle is between about 12 and 40 degrees. Regardless of the angle at which a gap is formed, the gap may have a suitable length such that it spans across partially across a widthwise dimension of the shield element 600 to facilitate formation of one or more fusible elements.

Figure 7A:
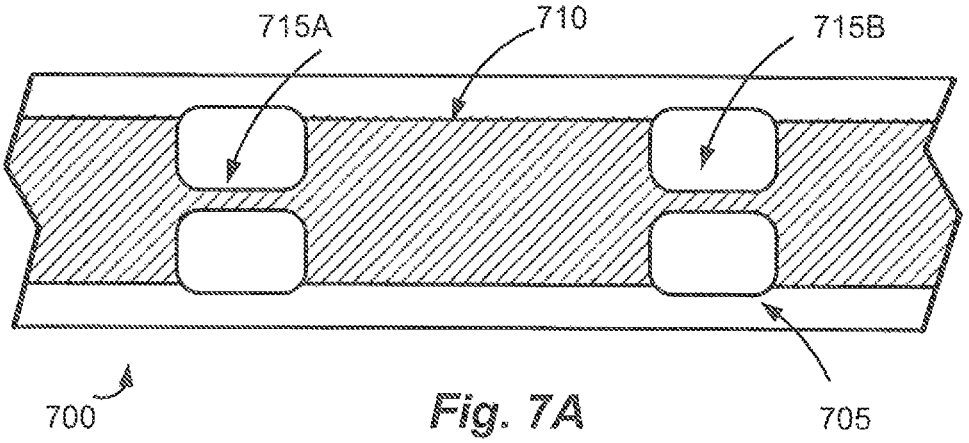
Figure 7B:
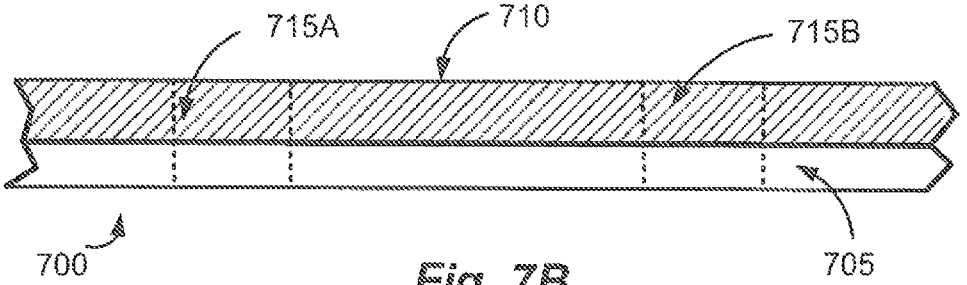

FIGS. 7A and 7B respectively illustrate top level and cross-sectional views of another continuous shield structure 700 in which gaps or holes are formed at angles that are perpendicular to the longitudinal direction of the structure 700. The shield structure 700 may include a base dielectric layer 705, and electrically conductive material 710 may be formed on the base dielectric layer 705. Additionally, longitudinally spaced gaps or holes 715A, 715B may be formed through both the electrically conductive material 710 and the dielectric layer 705. As shown, each section of gaps 715A, 715B may include two respective rectangular gaps that are each formed partially across a width of the electrically conductive material at an angle that is perpendicular to the longitudinal direction. Each section of gaps 715A. 715B may divide longitudinally adjacent segments or patches of electrically conductive material. Additionally, one or more fusible elements may longitudinally extend between the segments of electrically conductive material in the areas along the widthwise dimension of the electrically conductive material not affected by the gaps (e.g., areas across which the gaps do not extend). As shown in FIG. 7A, in certain embodiments, a fusible element may be positioned approximately at a widthwise midpoint. In other embodiments, one or more fusible elements may be positioned at other locations along a widthwise dimension. In yet other embodiments, the widthwise positions of two or more fusible elements may vary between different sets of longitudinally spaced electrically conductive segments.

Figure 8A:
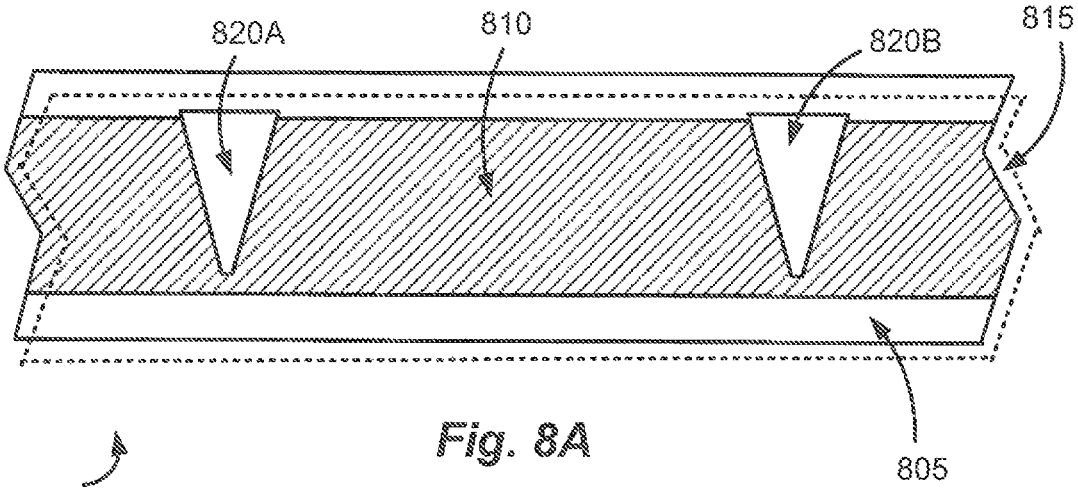

In certain embodiments, continuous shield structures may be formed in which electrically conductive material is sandwiched between two layers of dielectric material. FIGS. 8A and 88 respectively illustrate a top view and a cross-sectional view of an example shield structure 800 in which electrically conductive material 810 is positioned between two layers of dielectric material 805, 815. For example, electrically conductive material 810 may be formed on a base layer of dielectric material 805, and a second layer of dielectric material 815 may be positioned on an opposite side or surface of the electrically conductive material 810. Additionally, as shown in FIGS. 8A and 88, a plurality of longitudinally spaced gaps or holes, such as gaps 820A and 820B, may be formed through the electrically conductive material 810 and the dielectric layers 805, 815. Each gap 820A, 820B may extend partially across a width of the electrically conductive material 810 to facilitate the formation of one or more fusible elements.

Figure 8B:
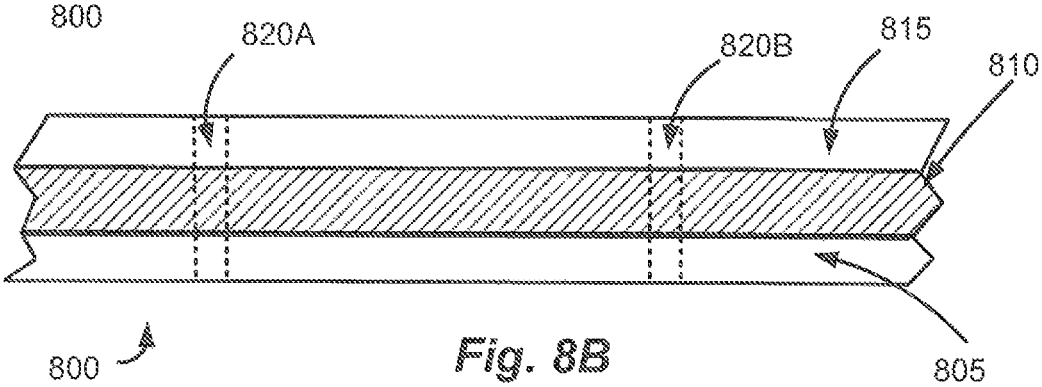
Figure 9:
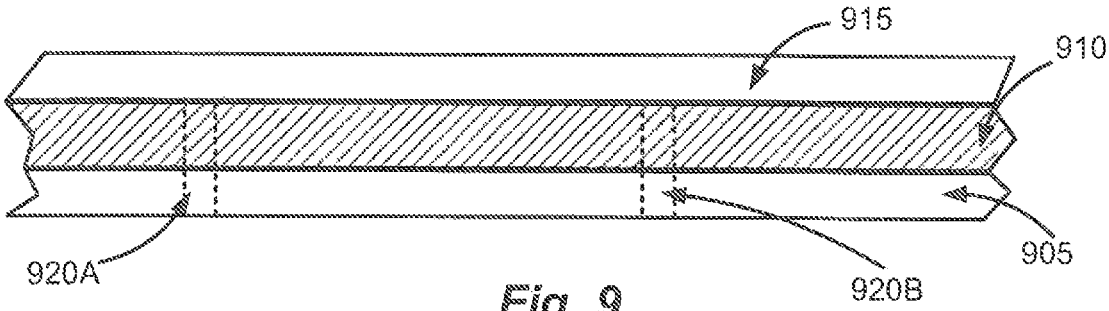

During the formation of the shield structure 800 illustrated in FIGS. 8A and 8B, the second layer or sandwiching layer of dielectric material may be added to the structure 800 prior to the formation of gaps or holes. In other example shield structures, such as the shield structure 900 illustrated in FIG. 9, gaps or holes may be formed prior to the addition of a sandwiching layer of dielectric material. FIG. 9 illustrates a cross-sectional view of an example shield structure 900 in which electrically conductive material 910 is formed on a base dielectric layer 905. Longitudinally spaced gaps or holes, such as gaps 920A and 920B, may then be formed through the electrically conductive material 910 and the base dielectric layer 905. Following the formation of the gaps or holes, a sandwiching layer of dielectric material 915 may be joined to the electrically conductive material 910 and/or the base dielectric layer 905.

Figure 10:
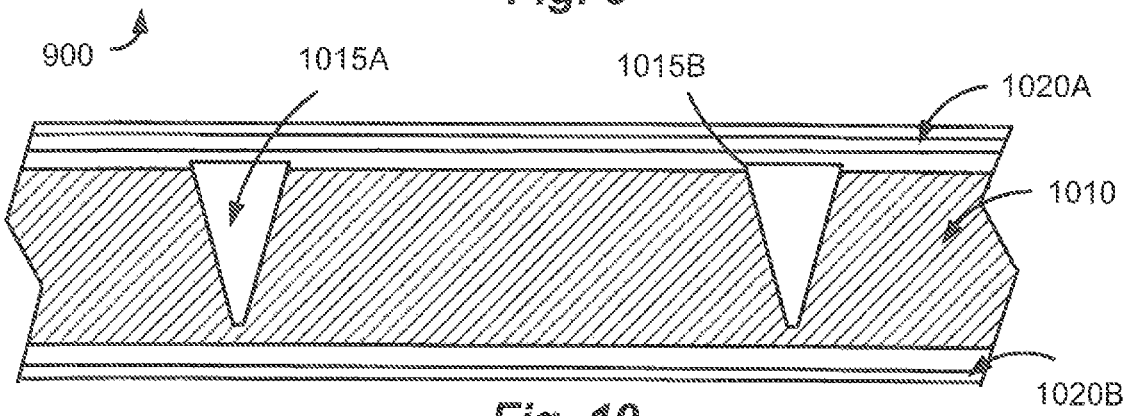

In certain embodiments, one or more strength members may be incorporated into a continuous shield structure. FIG. 10 illustrates a top level view of an example shield structure 1000 that includes strength members, such as strength yarns. The shield structure 1000 may include at least a base layer of dielectric material 1005, and electrically conductive material 1010 may be formed on the base dielectric layer 1005. As desired, an optional sandwiching dielectric layer may also be provided. A plurality of longitudinally spaced gaps or holes, such as gaps 1015A and 1015B, may be formed through at least the electrically conductive material 1010 and the base dielectric layer 1005. Each gap 1015A, 1015B may extend partially across a width of the electrically conductive material 1010 to facilitate the formation of one or more fusible elements.

Additionally, the base dielectric layer 1005 may have a width that is greater than that of the electrically conductive material 1010 such that the base dielectric layer 1005 extends beyond the electrically conductive material 1010 along one or both widthwise edge. One or more longitudinally extending strength members, such as strength members 1020A and 1020B, may be positioned within the overhanging regions of the base dielectric layer 1005. As illustrated, the base dielectric layer 1005 may extend beyond the electrically conductive material along both widthwise edges, and a respective strength member 1020A, 1020B may be positioned within each overhanging region. In other words, the strength members 1020A, 1020B may be positioned such that gaps or holes 1015A, 1015B are not formed through the strength members 1020A, 1020B or positioned over or under the strength members 1020A, 1020B. The strength members 1020A, 1020B may extend along the longitudinal direction of the structure 1000 parallel to the electrically conductive material 1010. Additionally, the strength members 1020A. 1020B may provide structural support to the shield structure 1000.

In other embodiments, a strength member may be positioned over a region of the electrically conductive material through which no gaps are formed, such as a region in which fusible elements are formed. As desired, the strength member may be adhered or otherwise affixed to the electrically conductive layer and/or held in place by a sandwiching layer of dielectric material (e.g., a layer of dielectric material formed over the electrically conductive material 110 opposite the base layer 1005).

Figure 11A:
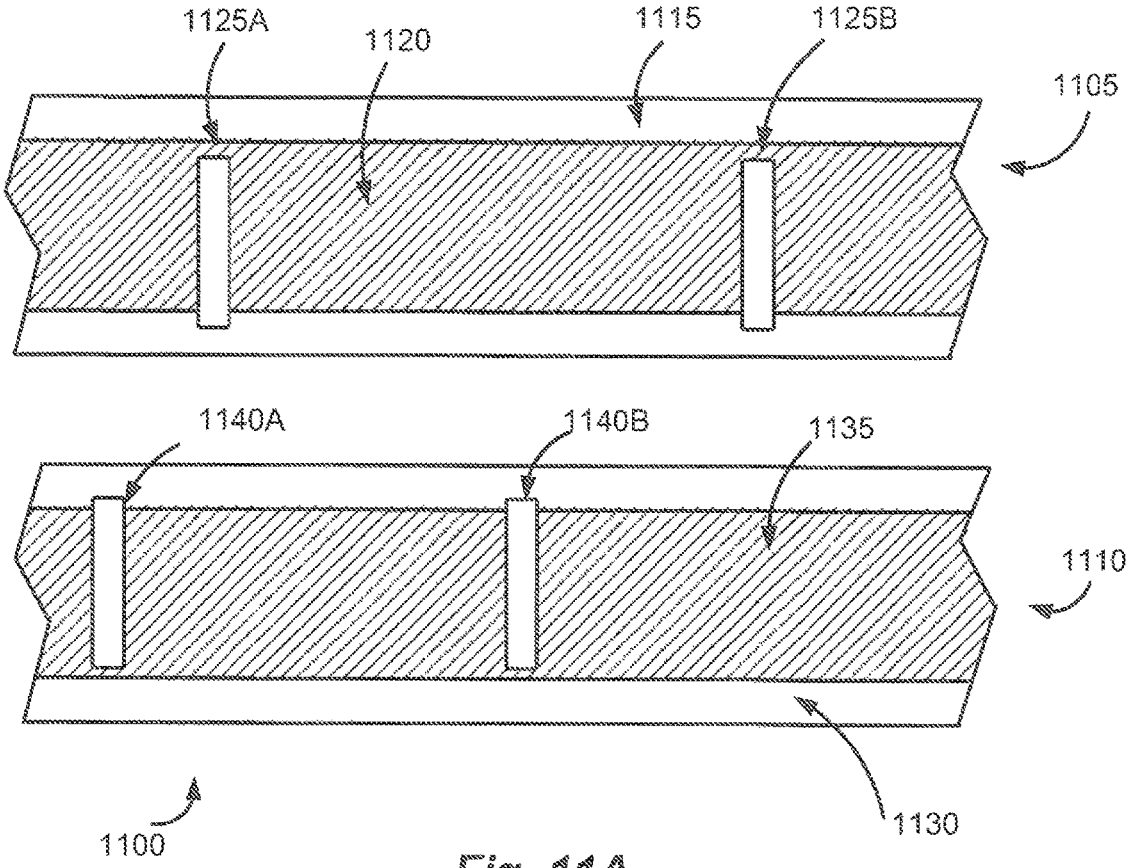
Figure 11B:
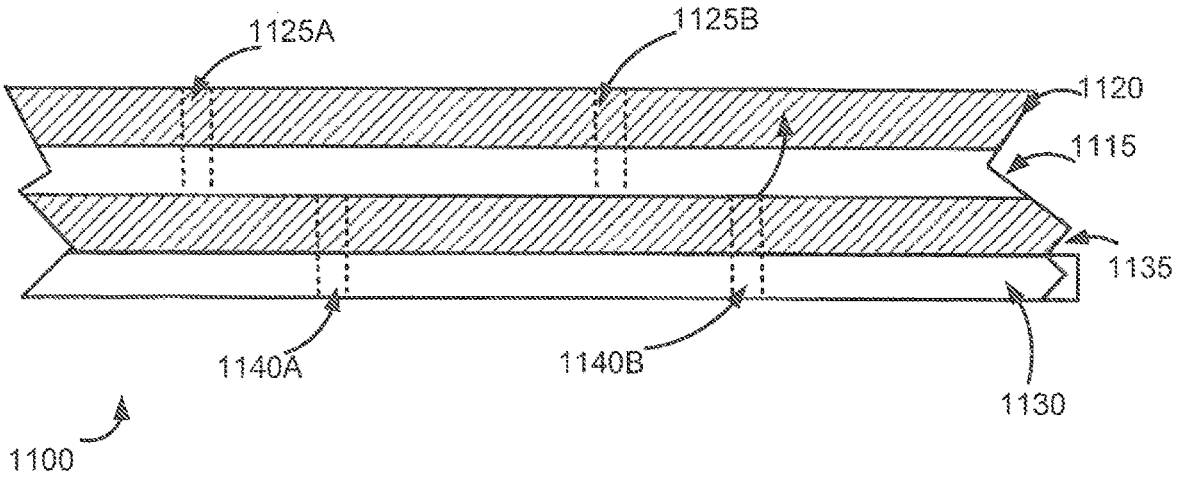

As desired in various embodiments, shield structures may be formed with a plurality of layers of electrically conductive material. For example, gaps or holes formed through a first layer of electrically conductive material may be covered by electrically conductive material included in a second layer. FIGS. 11A and 11B illustrate an example shield structure 1100 that includes a plurality of layers of electrically conductive material. With reference to FIG. 11, two separate shield structures 1105, 1110 may be formed. The first structure 1105 may include a base dielectric layer 1115 with electrically conductive material 1120 formed thereon. Additionally, longitudinally spaced gaps or holes, such as gaps 1125A and 1125B, may be formed through the electrically conductive material 1120 and the base layer 1115. Similarly, the second structure 1110 may include a base dielectric layer 1130 with electrically conductive material 1135 formed thereon. Longitudinally spaces gaps or holes, such as gaps 1140A and 1140B, may be formed through the electrically conductive material 1135 and the base dielectric layer 1130.

Once the two individual shield structures 1105, 1110 have been formed, the structures 1105, 1110 may be joined, bonded, or otherwise combined together in order to form an overall shield structure 1100, as illustrated by cross-section in FIG. 11B. In certain embodiments, the gaps or holes formed through a first of the component shield structures may be offset from the gaps or holes formed through a second of the component shield structures. In this regard, the electrically conductive material of each of the component shield structures may cover the gaps or holes formed through the other component shield structure. As a result, the overall shield structure 1100 may provide enhanced shielding as it may be more difficult for electrical signals to leak through or be transmitted through the shield structure 1100.

Figure 12:
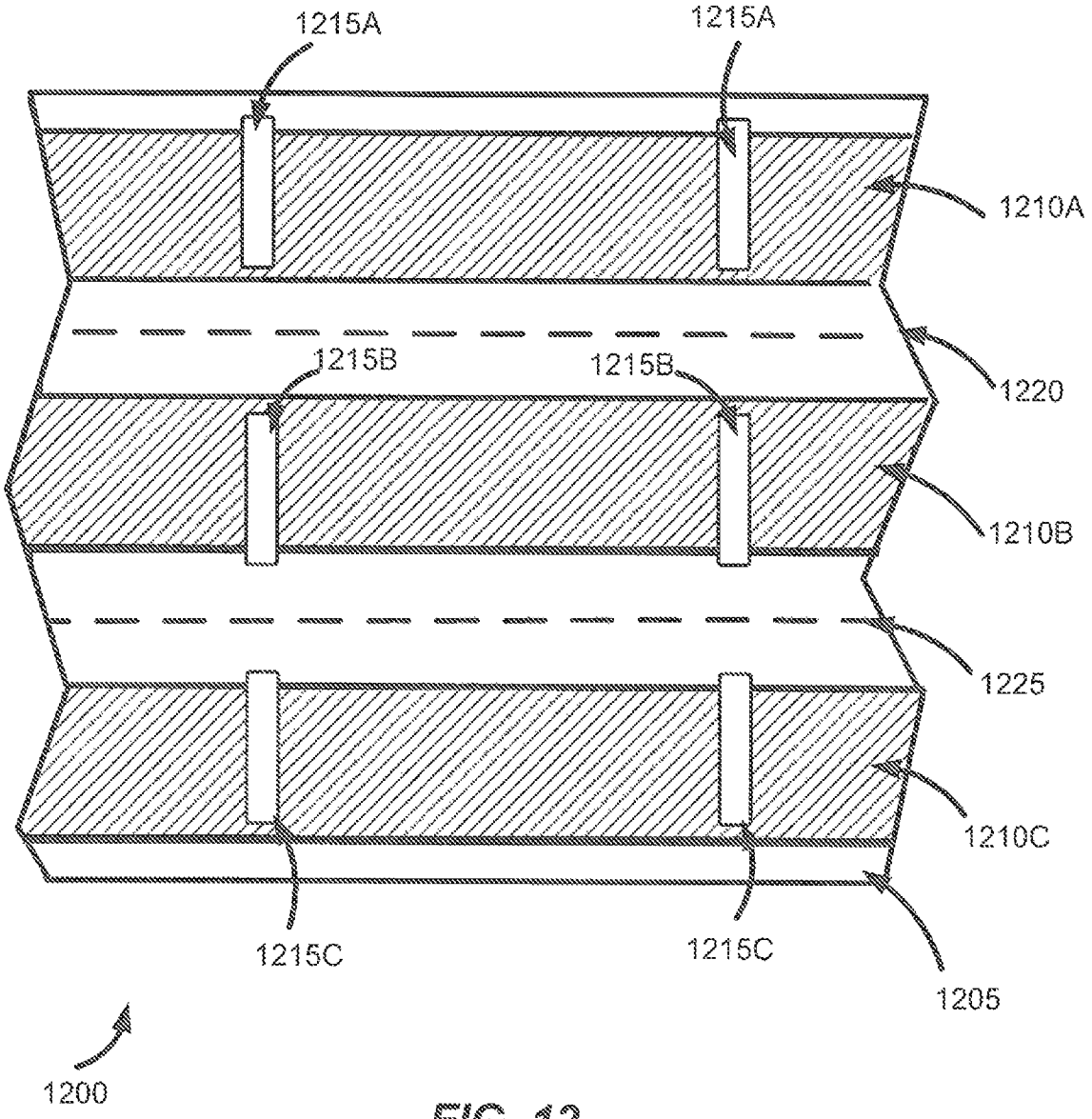

As described in greater detail above with reference to the system 400 of FIG. 4, in certain embodiments, a plurality of shield structures may be simultaneously formed utilizing a single base dielectric layer, and the individual shield structures may subsequently be separated from one another. FIG. 12 illustrates a top level view of example structure 1200 that may be cut or slit in order to form a plurality of continuous shield structures. As shown, the structure 1200 may include a base layer of dielectric material 1205, and a plurality of longitudinally extending strips 1210A, 1210B, 1210C of electrically conductive material may be formed on the base layer 1205. Although three strips of electrically conductive material are illustrated, any number of strips of electrically conductive material may be provided as desired. As desired, other components may be incorporated into the structure 1200, such as a sandwiching layer of dielectric material and/or any number of strength members.

The electrically conductive strips 1210A, 1210B, 1210C may extend along a longitudinal direction in parallel to one another. As shown, each of the strips 1210A, 1210B, 1210C may have widths that are approximately equal; however, in other embodiments, at least two strips may be formed with different widths. Additionally, in certain embodiments, adjacent strips may be spaced from one another along a widthwise dimension that is parallel to the longitudinal direction. In other words, a portion of the base layer 1205 may be present between each pair of adjacent strips along the widthwise dimension. With continued reference to FIG. 12, respective longitudinally spaced gaps or holes may be formed through each of the electrically conductive strips 1210A, 1210B, 1210C and the base layer 1205. For example, a first set of longitudinally spaced gaps 1215A may be formed through the first strip 1210A, a second set of longitudinally spaced gaps 1215B may be formed through the second strip 12101B, and a third set of longitudinally spaced gaps may be formed through the third strip 1210C. Each set of gaps may have a length that extends partially across the widthwise dimension of a strip such that one or more fusible elements are formed.

Once the shield structure 1200 illustrated in FIG. 12 is formed, the structure 1200 may be slit or cut into a plurality of individual shield structures. For example, the structure 1200 may be slit along a longitudinal line 1220 positioned in a widthwise dimension between the first electrically conductive strip 1210A and the second electrically conductive strip 1210B. Similarly, the structure 1200 may be slit along a longitudinal line 1225 positioned in a widthwise dimension between the second electrically conductive strip 1210B and the third electrically conductive strip 1210C. In certain embodiments, a longitudinal slit may be formed such that one or more of the individual shield structures includes portions of the base layer 1205 that extend beyond the electrically conductive material along the widthwise edge at which the slit is formed.

In other embodiments, a single layer or strip of electrically conductive material may be formed on the base layer. A plurality of sets of longitudinally spaced gaps or holes may be formed through the electrically conductive material and the base layer. The structure may then be cut or slit along one or more longitudinal lines in order to form a plurality of continuous shield structures. Each of the continuous shield structures may have electrically conductive material that spans across a widthwise dimension of its underlying base layer. In other embodiments, the shield structures cut near opposite widthwise edges of the overall structure may have dielectric material that extends beyond the electrically conductive material along a single edge. Further, the gaps may be formed such that fusible elements extend between longitudinally adjacent segments of electrically conductive material within each of the plurality of continuous shield structures.

Regardless of the number of layers incorporated into a shield structure, a shield structure may be formed with a wide variety of suitable gap configurations and/or arrangements of fusible elements. FIGS. 13A-13L illustrate top level views of example configurations or arrangements of gaps and fusible elements that may be utilized in association with continuous shield structures in various embodiments of the disclosure. Any of the shield structures described above with reference to FIGS. 5A-12 may be formed with any of the example gap and fusible element constructions illustrated in FIGS. 13A-13L, as well as with a wide variety of other suitable layer constructions. Further, FIGS. 13A-13L illustrate example shield structure configurations in which a layer of electrically conductive material has a width that is approximately equal to that of an underlying base layer. As shown in FIGS. 5A-12, other shield structures may be formed in which a layer of electrically conductive material has a width that is less than that of an underlying base layer. The gap configurations and/or arrangements of fusible elements illustrated in FIGS. 13A-13L are equally applicable to shield structures in which a layer of electrically conductive material has a width that is less than that of an underlying base layer.

Figure 13A:
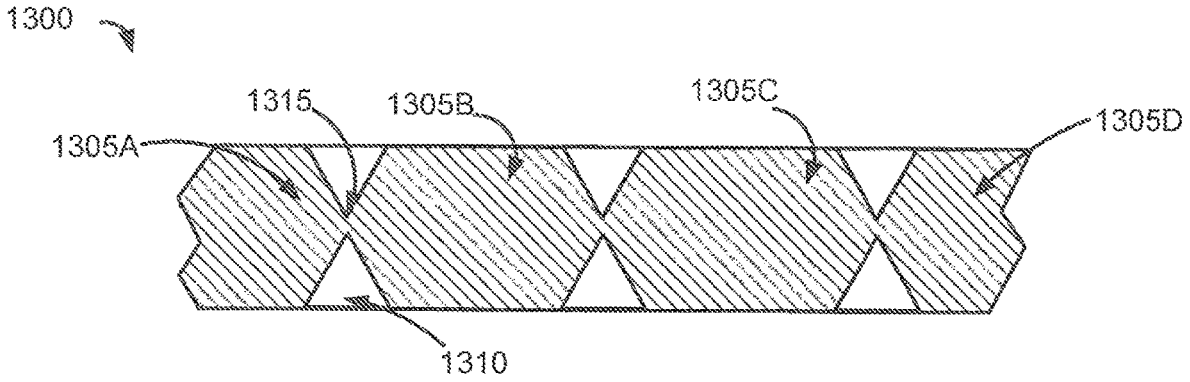

Turning to FIG. 13A, a first example shield structure 1300 is illustrated in which a plurality of longitudinally spaced segments 1305A-D of electrically conductive material are formed on a dielectric layer 1310. For each longitudinally adjacent set or pair of spaced segments (e.g., segments 1305A, 1305B), gaps may be formed such that at least one of the segments may narrow or taper as it extends towards the adjacent segment. As shown in FIG. 13A, both segments included in a pair of segments (e.g., segments 1305A, 1305B) may narrow or taper as they extend towards one another. In other embodiments, only a single segment may narrow or taper. For example, a first segment (e.g., segment 1305A) may narrow or taper as it approaches a second segment (e.g., 1305B) having an edge that is formed perpendicularly across the shield element 1300 (i.e., in a widthwise direction perpendicular to the longitudinal direction). As desired, gaps may be formed such that a spaced segment tapers or narrows at any suitable angle or by any other suitable amount. Regardless of whether one or both segments taper or narrow, a fusible element 1315 between the two segments (e.g., segments 1305A, 1305B) may be formed at or proximate to the narrowest point(s) of the taper(s). In other words, gaps may be formed partially across a width of the electrically conductive material such that fusible elements are positioned between adjacent longitudinally spaced segments 1305A-D. In certain embodiments, a fusible element 1315 may include portions of the tapering sections or elements that are susceptible to fusing in the presence of a minimum fusing current. In other embodiments, a fusible element 1315 may extend across a longitudinal gap or spacing from one or more narrowest point(s) of the taper(s).

Figure 13B:
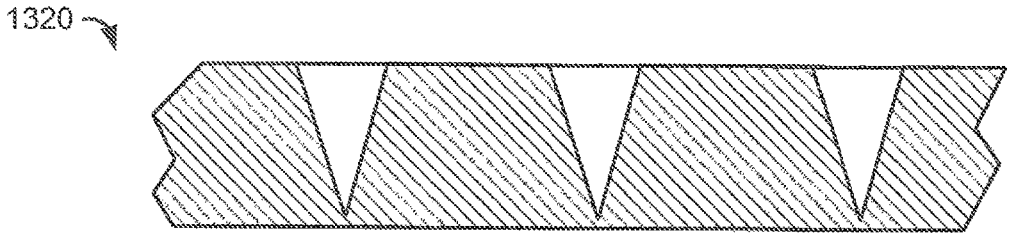

FIG. 13B illustrates a second example shield structure 1320 in which one or both segments included in a pair of longitudinally adjacent segments tapers or narrows in the longitudinal direction as they approach one another. However, while the shield structure 1300 of FIG. 13A includes tapering segments that form a fusible element at or near a widthwise midpoint of the shield structure 1300, the shield structure 1320 of FIG. 13B includes tapering segments that form a fusible element at or near one widthwise edge of the shield structure 1320. In other words, one or more gaps may extend from a first widthwise edge of the electrically conductive material and partially across a width of the electrically conductive material such that fusible elements are formed proximate two an opposite widthwise edge. As desired, gaps may be formed such that one or more spaced segments taper in order to form fusible elements at any desired locations positioned between the spaced segments. Further, in certain embodiments, each set of spaced segments may have fusible elements formed at similar widthwise locations. In other embodiments, at least two pairs of spaced segments may have fusible elements formed at different widthwise locations (e.g., at or near opposite widthwise edges, etc.).

Figure 13C:
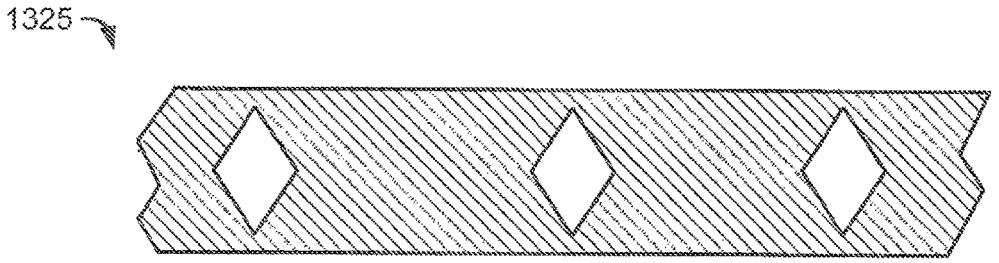

Additionally, although FIGS. 13A and 13B illustrate shield structure 1300, 1320 that include single fusible elements formed between each pair of longitudinally adjacent spaced segments, any suitable number of fusible elements may be formed between each pair of spaced segments. FIG. 13C illustrates an example shield structure 1325 in which two fusible elements are formed between each pair of spaced segments. For example, fusible elements may be formed between each set of spaced segments at or proximate two each of the widthwise edges. In other words, gaps formed through the electrically conductive material and base layer may be positioned between widthwise edges of the electrically conductive material. As desired, the widthwise locations of multiple fusible elements may be similar between each set of adjacent spaced segments or, alternatively, the locations of multiple fusible elements may vary between at least two spaced segments. Further, the number of fusible elements formed between each adjacent set of spaced segments may be constant along a longitudinal length or alternatively, a different number of fusible elements may be formed between at least to sets of spaced segments.

Figure 13D:
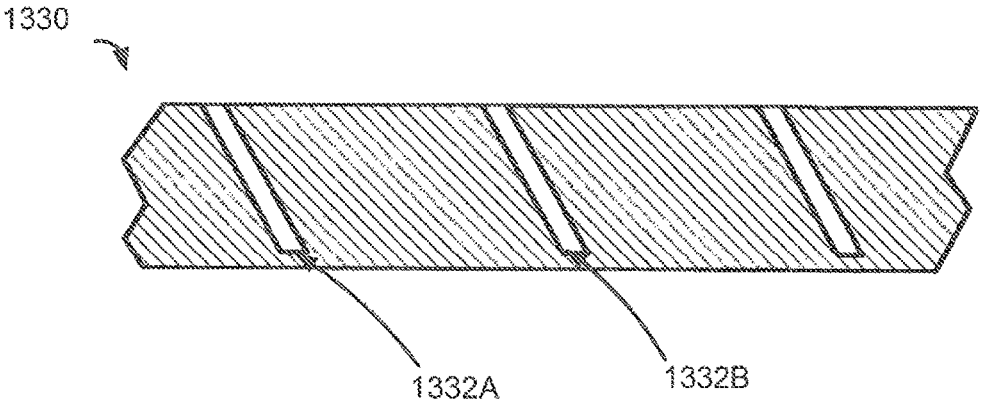

In certain embodiments, a shield structure may be formed with gaps that result in a plurality of longitudinally spaced segments of electrically conductive material with one or more fusible elements spanning across each longitudinal distance between segments formed by the gaps in order to provide electrical continuity between the spaced segments. As desired, a gap may be formed at any suitable angle between two spaced segments. FIG. 13D illustrates an example shield structure 1330 in which gaps are formed at an angle between the longitudinal direction and the perpendicular widthwise direction of the shield structure 1330. As explained in greater detail above, angled gaps or spaces may provide improved shielding performance in certain embodiments. By contrast, FIGS. 13E-13L illustrate example shield structures in which gaps are formed at a perpendicular (e.g., 90 degree) angle to the longitudinal direction (e.g., along the widthwise direction). Any of the shield structures of FIGS. 13E-13L may include gaps formed at different angles. Regardless of the angle at which a gap is formed, a gap may only extend partially across a width of the electrically conductive material such that one or more fusible elements extend across a longitudinal spacing between segments in any suitable direction and/or combinations of directions. The shield structure 1330 of FIG. 13D includes fusible elements 1332A, 1332B that are positioned proximate to one of the widthwise edges of the shield structure 1330. In other embodiments, fusible elements may be positioned at other widthwise locations or in a plurality of different widthwise locations.

Figure 13E:
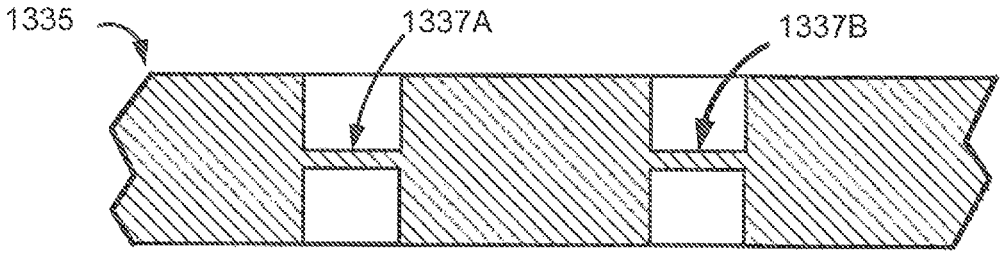
Figure 13F:
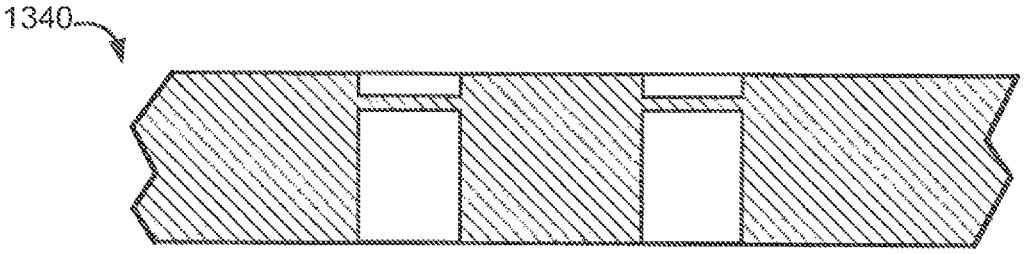

FIG. 13E illustrates an example shield structure 1335 in which fusible elements 1337A, 1337B extend between adjacent spaced segments in a longitudinal direction. In certain embodiments, fusible elements 1337A, 1337B extend between adjacent segments with a shortest possible overall length. In other words, a length of a fusible element 1337A, 1337B may defined by one or more gaps to correspond to the longitudinal length (or width in a longitudinal direction) of the gap or space. Additionally, the shield structure of FIG. 13E illustrates fusible elements 1337A, 1337B that are formed at or proximate to a widthwise midpoint of the shield structure 1335. FIG. 13F illustrates an example shield structure 1340 in which fusible elements are formed between spaced segments at or near a widthwise edge of the shield structure 1340. As desired, various fusible elements may be formed at any suitable widthwise location and/or combinations of widthwise locations (for example, as shown in FIG. 13J).

Figure 13G:
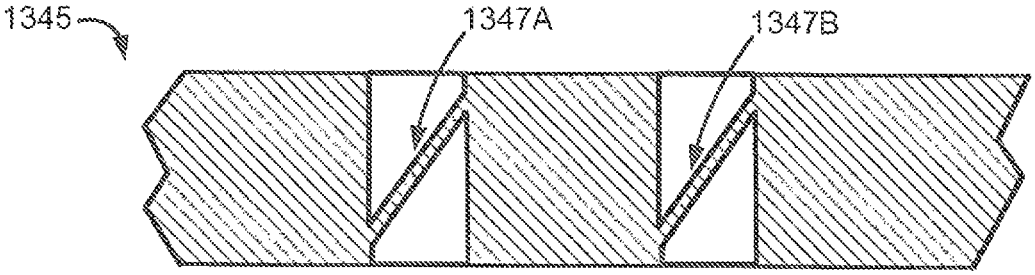

FIG. 13G illustrates an example shield structure 1345 in which one or more fusible elements 1347A, 1347B span between respective pairs of spaced segments at an angle relative to the longitudinal direction of the shield structure 1345. For example, a plurality of gaps may be formed between each set of adjacent spaced segments, and the gaps may include one or more angled dimensions relative to the longitudinal direction in order to form one or more angled fusible elements. An angle may result in a fusible element (generally referred to as fusible element 1347) having a length that is greater than the longitudinal length (or width in a longitudinal direction) of the gap or space between two spaced segments. The longer length of the fusible element 1347 may increase or enhance the likelihood that the fusible element may fuse in the event that a minimum fusing current is applied. Additionally, in certain embodiments, the angled direction of the fusible element 1347 may reduce the likelihood of severing or damaging the fusible element 1347 in the event that stresses or forces are exerted on the shield structure 1345, such as stretching or twisting forces. A fusible element 1347 may extend between two spaced segments at any suitable angle as desired in various embodiments of the disclosure, such as an angle of approximately 25, 30, 35, 40, or 45 degrees relative to the longitudinal direction, at an angle included in a range between any two of the above values, or at an angle included in a range bounded on either a minimum or maximum end by one of the above values.

Figure 13H:
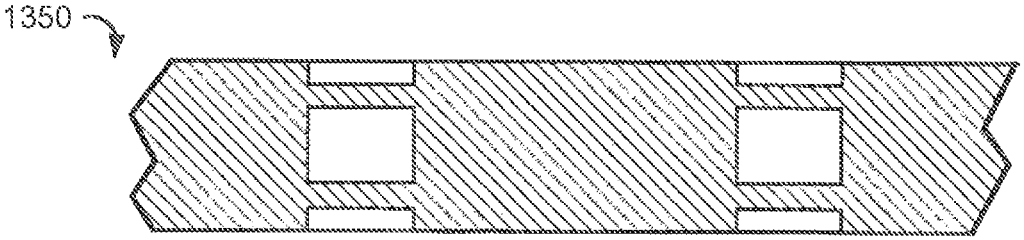

As shown in FIGS. 13E-13G, certain shield structures may include a single fusible element that extends between each pair of longitudinally adjacent spaced segments. In other embodiments, a plurality of fusible elements may be provided between one or more sets of adjacent spaced segments. FIG. 13H illustrates an example shield structure 1350 in which two fusible elements extend or span between each pair of longitudinally adjacent spaced segments. In other words, a plurality of gaps may be formed between each set of adjacent segments to result in the formation of a plurality of fusible elements. Other suitable numbers of fusible elements may be utilized between spaced segments as desired in other embodiments. Additionally, in certain embodiments, the same number of fusible elements may extend between each respective pair of spaced segments. In other embodiments, a different number of fusible elements may extend between at least two respective pairs of spaced segments. Further, the shield structure 1350 of FIG. 13H illustrates fusible elements that extend along the longitudinal direction. As desired in other embodiments, one or more of the fusible elements may extend at an angle relative to the longitudinal direction or in any other suitable direction or combination of directions.

Figure 13I:
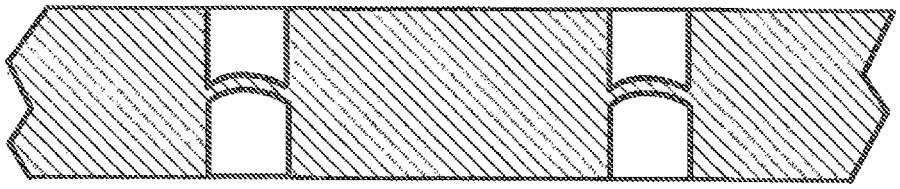
Figure 13J:
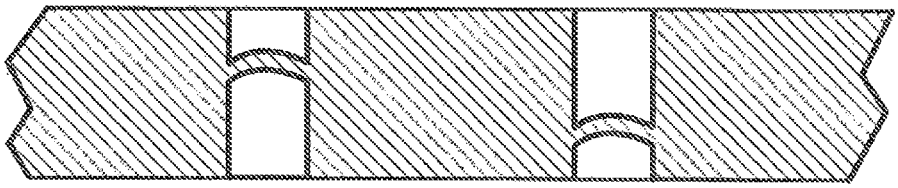

In certain embodiments, a shield structure may include one or more fusible elements that extend between spaced segments in a direction that includes at least one curve or are. In other words, gaps including at least one curve or arc may be formed through the electrically conductive material to result in fusible elements having at least one corresponding curve or arc. FIG. 13I illustrates an example shield structure 1355 in which fusible elements extend between spaced segments with a curved or arcuate shape. In other embodiments, a fusible element may extend between spaced segments with a sinusoidal shape or any other suitable shape that includes at least one curve. The fusible elements of FIG. 13I are positioned near a widthwise midpoint of the shield structure 1355. FIG. 13J illustrates another example shield structure 1360 in which curved or arcuate fusible elements are positioned at other widthwise locations, such as proximate to one or both widthwise edges. In certain embodiments, fusible elements may be positioned at similar widthwise locations. In other embodiments, as shown in FIG. 13J, at least two fusible elements may be positioned at different widthwise locations. A curve incorporate into a fusible element may be formed with any suitable degree of curvature. As a result of being formed with a shape or in a direction that includes at least one curve or arc, an overall length of a fusible element may be increased, thereby increasing a likelihood of fusing. Additionally, incorporation of a curve or arc may reduce the likelihood of severing or damaging a fusible element in the event that stresses or forces are exerted on a shield structure. For example, if a shield structure is stretched during manufacture, transport and/or installation of a cable, a curved fusible element may be less likely to break or sever.

Figure 13K:
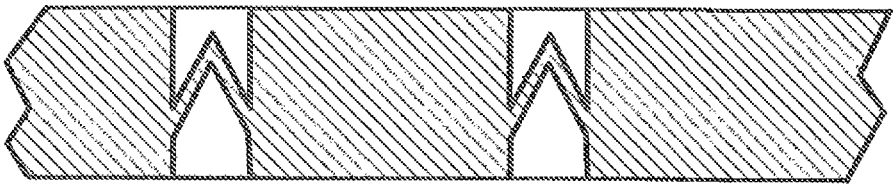
Figure 13L:
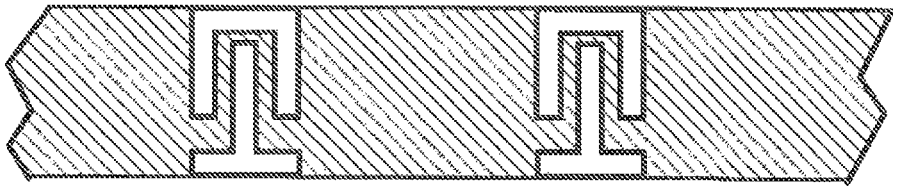

As set forth above, one or more benefits may be provided as a length of a fusible element is increased. It will be appreciated that a wide variety of different fusible elements may be formed between two spaced segments that include a length longer than the longitudinal length (or width in a longitudinal direction) of one or more gaps formed between the segments. These fusible elements may include any number of curves, bends, angles, and/or other direction variations that result in a longer length. For example, FIG. 13K illustrates an example shield structure 1365 in which one or more fusible elements include a "V-shape" resulting in an elongated fusible element with an acute angle formed therein. Gaps having suitable "V-shapes" may be formed through the electrically conductive material on opposite sides of the fusible element in order to define a shape of the fusible element. FIG. 13L illustrates an example shield structure 1370 in which one or more fusible elements include a plurality of right angle bends that result in the fusible element having an elongated width. In other embodiments, fusible elements may extend in a wide variety of other combinations of directions in order to span a gap between spaced segments. A wide variety of gaps and/or combinations of gaps may be formed in order to define various fusible element shapes as desired.

A wide variety of other gap and/or fusible element configurations may be utilized as desired in a shield structure. These configurations may include any number of gaps and/or fusible elements that extend in a wide variety of suitable directions. Further, a shield structure may be formed that incorporates any suitable combination of the gap and/or fusible element configurations described above with reference to FIGS. 5A-13L. A shield structure may also include any number of layers of material. The shield structures illustrated in FIGS. 5A-13L are provided by way of non-limiting example only.

Example Method for Forming Continuous Shield Structures

Figure 14:
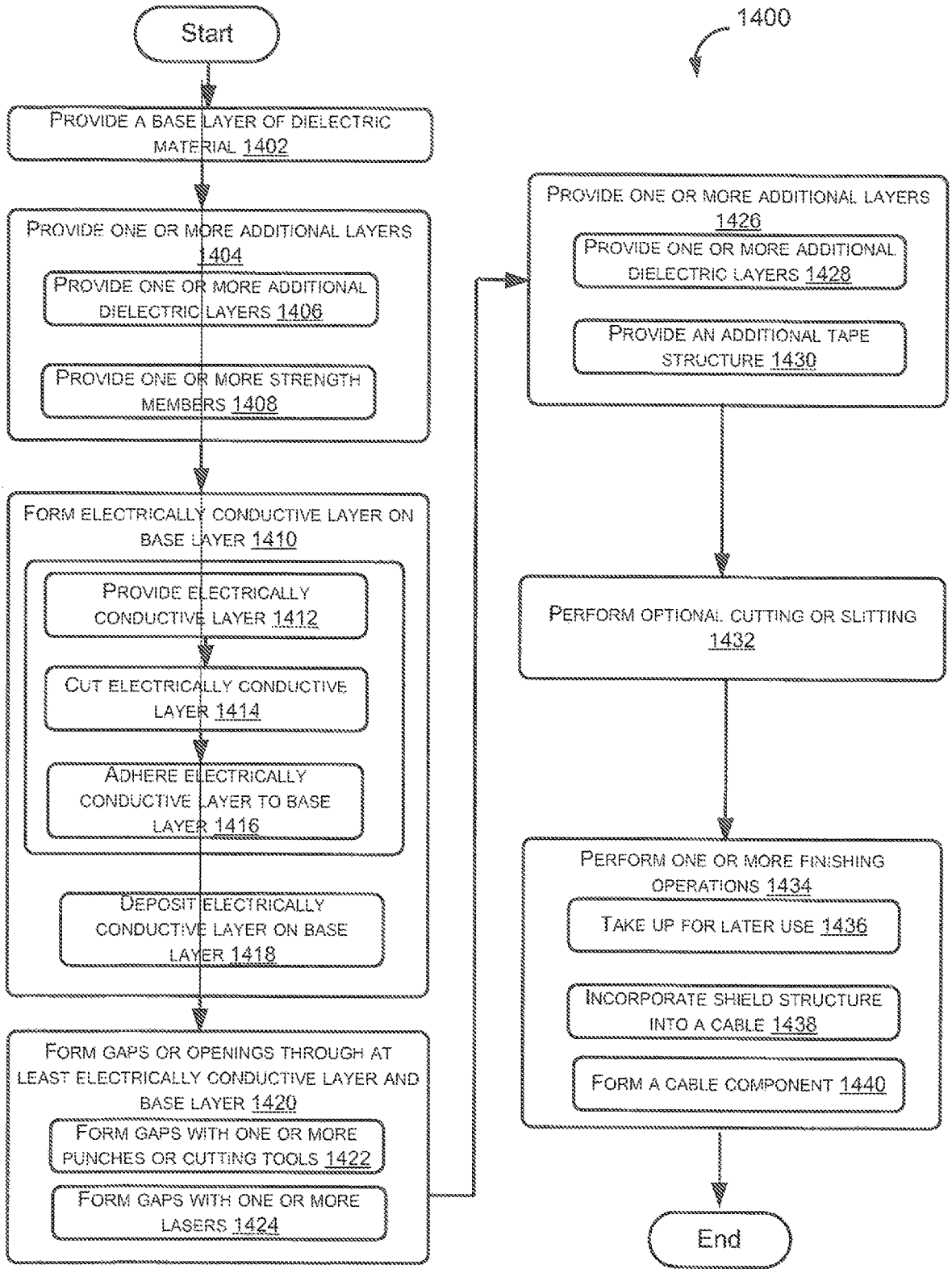
FIG. 14 is a flow diagram illustrating an example method for manufacturing or forming a continuous shield structure in accordance with various embodiments of the disclosure.

FIG. 14 is a flow diagram illustrating an example method 1400 for manufacturing or forming a continuous shield structure in accordance with various embodiments of the disclosure. Certain operations of the method 1400 may be performed by any number of suitable continuous shield structure manufacturing systems, such as one or more of the systems described above with reference to FIGS. 1-4. The method 1400 may begin at block 1402.

At block 1402, one or more base layers of dielectric material may be provided. For example, a base layer of dielectric material may be fed from a spool, bin, or other suitable source. A wide variety of suitable types of dielectric material may be provided as desired, such as a suitable plastic material or a suitable polymeric material. At bock 1404, one or more additional layers of material may optionally be provided. For example, one or more additional layers of dielectric material may be provided at block 1406, such as a "sandwiching" layer of dielectric material. As another example, one or more strength members, such as one or more strength yarns, may be provided at block 1408.

At block 1410, electrically conductive material may be formed on the base dielectric layer. A wide variety of suitable methods or techniques may be utilized to form electrically conductive material on the base dielectric layer. For example, at block 1412, one or more preformed electrically conductive layers, such as a metallic foil or a metal braid, may be provided. In certain embodiments, electrically conductive material may be supplied from one or more suitable spools, bins, or other sources. At block 1414, supplied electrically conductive material may optionally be cut or slit into a plurality of electrically conductive strips of material. The electrically conductive material or strips may then be adhered to, bonded to, or otherwise attached (e.g., attached with mechanical fasteners, etc.) to the base dielectric layer at block 1416. As desired, the electrically conductive material or strips may be "sandwiched" between two layers of dielectric material. As an alternative to forming an electrically conductive layer or strips from preformed electrically conductive material, an electrically conductive layer or electrically conductive strips may be deposited on the base dielectric layer at block 1418. For example, electrically conductive material may be sprayed, painted, extruded, or otherwise deposited on the base dielectric layer.

At block 1420, a plurality of longitudinally spaced gaps, holes, or openings may be formed through at least the electrically conductive layer and the base dielectric layer. In the event that a plurality of strips of electrically conductive material are provided, a respective plurality of longitudinally spaced gaps may be formed for each of the strips. A wide variety of suitable gap formation devices, components, and/or systems may be utilized to form gaps or openings as desired. For example, at block 1422, gaps may be formed with one or more suitable punches or cutting tools. As another example, at block 1424, gaps may be formed with one or more suitable lasers. As described in greater detail above, gaps may be formed with a wide variety of suitable dimensions, at a wide variety of angles, and/or with a wide variety of suitable configurations. Additionally, any suitable longitudinal spacing may be provided between any two of the gaps. According to an aspect of the disclosure, each gap may extend partially across a widthwise dimension of the electrically conductive material. As a result, the gap(s) formed at each spaced location may define a set of longitudinally adjacent segments of electrically conductive material with one or more fusible elements extending between the adjacent segments.

Following the formation of gaps, operations may continue at block 1426. At block 1426, one or more additional layers of material may optionally be provided. For example, at block 1428, one or more additional dielectric layers, such as a "sandwiching" dielectric layer may be provided. In this regard, a "sandwiching" layer may be provided that does not include gaps, thereby providing additional support to the shield structure. As another example, at block 1430, one or more additional shield structures, such as one or more additional shield tape structures may be provided. In certain embodiments, an additional shield structure may include an electrically conductive layer and one or more layers of dielectric material, and longitudinally spaced gaps may be formed through at least the electrically conductive layer and a base dielectric layer. An additional shield structure may be formed in a similar manner as that described above with reference to blocks 1402-1424. Additionally, in certain embodiments, when an additional shield structure is provided and joined with the original shield structure, the gaps formed in each of the structures may be longitudinally offset from one another.

At block 1432, a shield structure may optionally be cut or slit in order to form a plurality of separate or individual shield structures. For example, if a plurality of strips of electrically conductive material are formed on a base dielectric layer, the base dielectric layer (and any other dielectric layers) may be slit at one or more lines that longitudinally extend between the strips in a widthwise dimension.

Finally, at block 1434, one or more finishing operations may be performed. In certain embodiments, one or more manufactured shield structures may be taken up or collected at block 1436 for subsequent use. Alternatively, at block 1438, one or more shield structures may be incorporated into a cable. For example, a shield structure may be provided to a cable assembly process or system in a continuous or in-line manner, and the shield structure may be incorporated into the cable. In yet other embodiments, at block 1440, one or more shield structures may be formed into one or more suitable cable components, such as a separator configured to be positioned between two or more twisted pairs in a cable. The method 1400 may end following block 1434.

As desired in various embodiments, the method 400 may include more or less operations than those described above with reference to FIG. 14. Additionally, in certain embodiments, any number of the described operations may be carried out or performed in parallel. The described method 1400 is provided by way of non-limiting example only.

Example Cable Constructions

Figure 15:
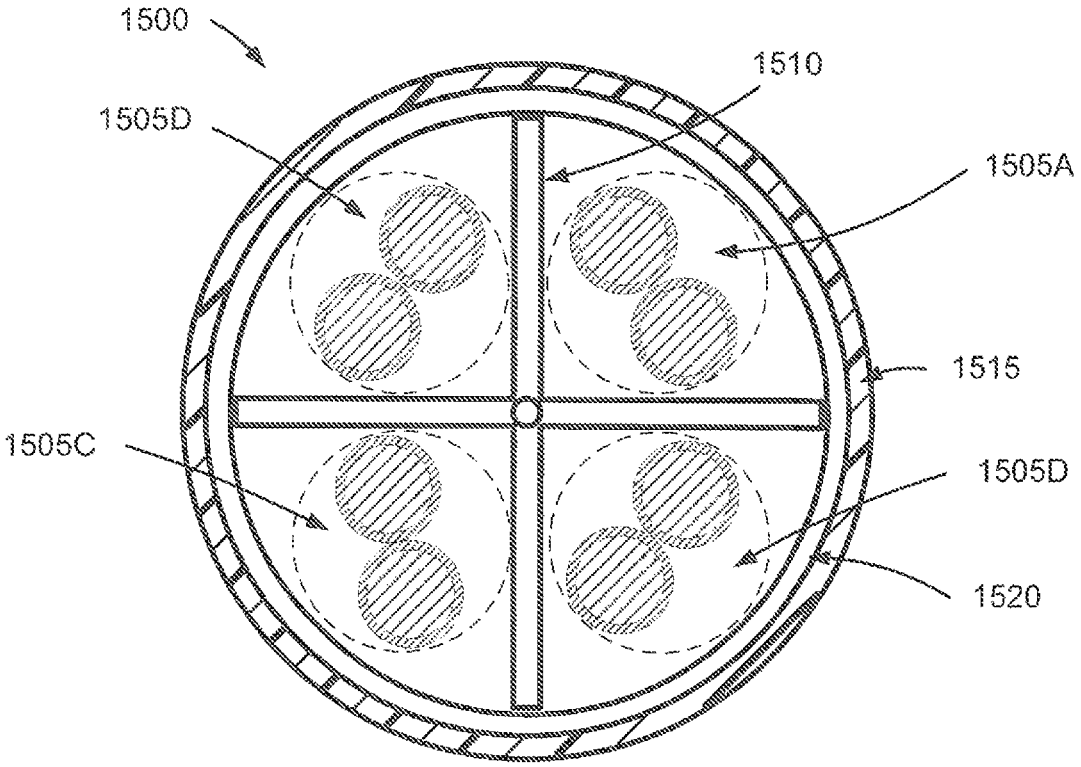
FIGS. 15-17 are cross-sectional views of example cables that may incorporate continuous shield structures, according to illustrative embodiments of the disclosure.
Figure 16:
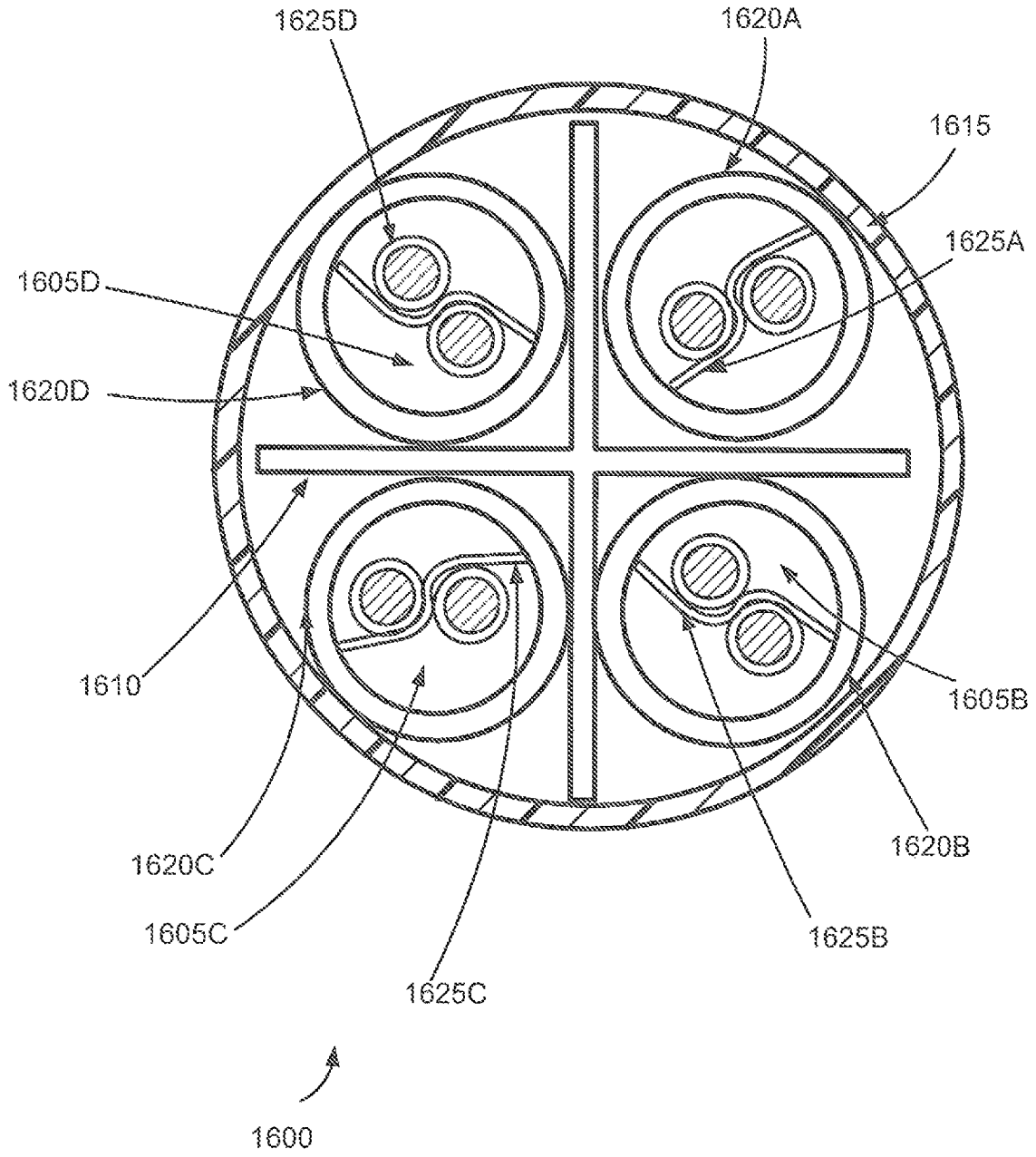
Figure 17:
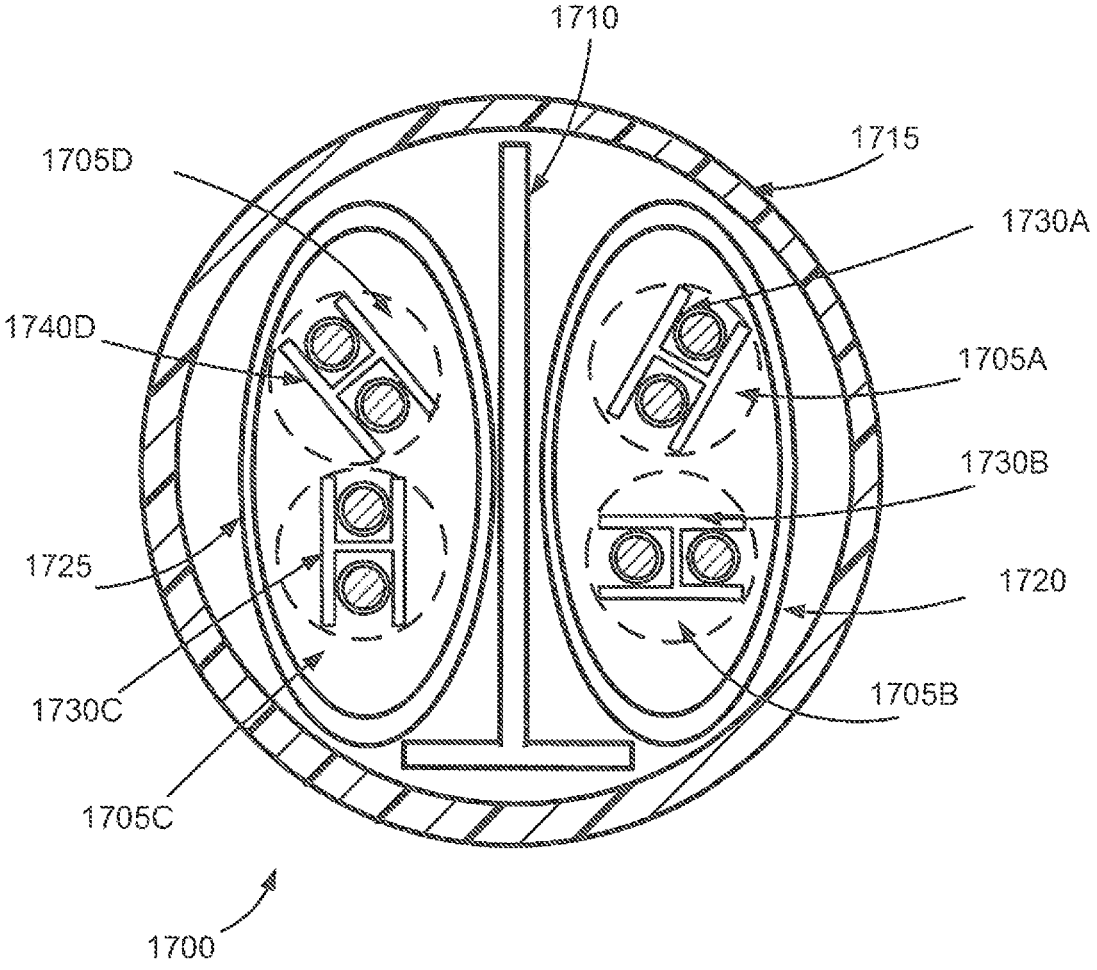

The continuous shield structures discussed herein may be incorporated into a wide variety of suitable types of cables, such as twisted pair communication cables, hybrid or composite cables (e.g., cables that include a combination of twisted pairs and other transmission media, etc.) riser cables, plenum cables, horizontal cables, vertical cables, flexible cables, equipment cords, cross-connect cables, etc. Additionally, the shield structures may be utilized to form a wide variety of suitable cable components, such as a twisted pair separator or a shield layer. FIGS. 15-17 are cross-sectional views of example cables that may incorporate continuous shield structures, according to illustrative embodiments of the disclosure.

With reference to FIG. 15, a cross-section of an example cable 1500 that may be utilized in various embodiments is illustrated. The cable 1500 is illustrated as a twisted pair communications cable that includes four twisted pairs 1505A, 1505B, 1505C, 1505D; however, any other suitable number of pairs may be utilized. Each twisted pair (referred to generally as twisted pair 1505) may include two electrical conductors, each covered with suitable insulation. The electrical conductors of a twisted pair 1505 may be formed from any suitable electrically conductive material, such as copper, aluminum, silver, annealed copper, gold, a conductive alloy, etc. Additionally, the electrical conductors may have any suitable diameter, gauge, and/or other dimensions. The twisted pair insulation may include any suitable dielectric materials and/or combination of materials. Additionally, the insulation may be formed from a single layer or a plurality of layers of material. Each of the twisted pairs may also have any suitable twist length and/or twist direction.

A jacket 1515 may enclose the internal components of the cable 1500, seal the cable 1500 from the environment, and/or provide strength and structural support. The jacket 1515 may be formed from a wide variety of suitable materials and/or combinations of materials, such as one or more polymeric materials, one or more polyolefins (e.g., polyethylene, polypropylene, etc.), polyvinyl chloride ("PVC"), one or more flame retardant olefins, a low smoke zero halogen ("LSZH") material, etc. The jacket 1515 may be formed as a single layer or, alternatively, as multiple layers.

With continued reference to FIG. 15, the cable 1500 may include an overall or external shield layer 1520, such as a shield layer positioned around the collection of twisted pairs 1505A-D. In certain embodiments, the shield layer 1520 may be formed from a continuous shield structure manufactured or otherwise provided in accordance with the disclosure set forth herein. For example, the shield layer 1520 may be formed from one of the continuous shield structures discussed above with reference to FIGS. 5A-13L. Accordingly, the shield layer 1520 may include segments of electrically conductive material with fusible elements extending between the segments.

A wide variety of suitable methods or techniques may be utilized as desired to incorporate a shield structure into the cable 1500 as a shield layer. For example, one or more cable components (e.g., the twisted pairs 1505A-D, etc.) may be positioned adjacent to the shield structure. The shield structure may then be folded at one or both edges such that it is circumferentially wrapped around the desired cable components. In certain embodiments, the shield structure may be passed through one or more suitable dies that function to wrap the shield structure into a shield layer.

With continued reference to FIG. 15, in certain embodiments, the cable 1500 may include a separator 1510 configured to orient and or position one or more of the twisted pairs 1505A-D. For example, a separator 1510 may be positioned between at least two of the twisted pairs 1505A-D. The orientation of the twisted pairs 1505A-D relative to one another may provide beneficial signal performance. As desired in various embodiments, the separator 1510 may be formed in accordance with a wide variety of suitable dimensions, shapes, or designs. For example, a flat tape separator, an X-shaped or cross-shaped separator, a T-shaped separator, a Y-shaped separator, a J-shaped separator, an L-shaped separator, a diamond-shaped separator, a separator having any number of spokes extending from a central point, a separator having walls or channels with varying thicknesses, a separator having T-shaped members extending from a central point or center member, a separator including any number of suitable fins, and/or a wide variety of other shapes may be utilized. In certain embodiments, a tape may be formed into a desired shape utilizing a wide variety of folding and/or shaping techniques. For example, a separator 1510 may be formed from a continuous shield structure manufactured or otherwise provided in accordance with the disclosure set forth herein.

A wide variety of suitable methods or techniques may be utilized as desired to form a shield structure into a separator. For the example separator 1510 illustrated in FIG. 15, a shield structure may first be formed into a shape having a relatively circular cross-section. For example, the widthwise edges of the separator may be brought into contact with one. In certain embodiments, the shield structure may be passed through one or more suitable dies that function to wrap the edges of the structure. The shield structure may then be passed through one or more dies that mash the structure into a shape having an "X" or cross shape. In other embodiments, other components may fold various edges of a shield structure in order to form an "X" or cross-shape. Additionally, similar techniques and/or systems may be utilized to form a shield structure into a separator having a desired cross-sectional shape.

FIG. 16 illustrates a cross-sectional view of another example cable 1600 that may incorporate one or more continuous shield structures. Similar to the cable 1500 discussed above with reference to FIG. 15, the cable 1600 may include a plurality of twisted pairs 1605A-D, and a jacket 1615 may be formed around the twisted pairs 1605A-D. Additionally, in certain embodiments, a suitable separator 1610 may be positioned between at least two of the twisted pairs 1605A-D. As desired, the separator 1610 may be formed from a continuous shield structure manufactured or otherwise provided in accordance with the disclosure set forth herein.

In contrast to the cable of FIG. 15, each of the twisted pairs 1605A-D of the cable 1600 may be individually shielded. For example, shield layers 1620A-D may respectively be wrapped or otherwise formed around each of the twisted pairs 1605A-D. In other words, a first shield layer 1620A may be formed around a first twisted pair 1605A, a second shield layer 1620B may be formed around a second twisted pair 1605B, a third shield layer 1620C may be formed around a third twisted pair 1605C, and a fourth shield layer 1620D may be formed around a fourth twisted pair 1605D. In other embodiments, a portion or none of the twisted pairs may be individually shielded. Indeed, a wide variety of different shielding arrangements may be utilized in accordance with various embodiments of the disclosure. In certain embodiments, at least one of the shield layers may be formed from a continuous shield structure manufactured or otherwise provided in accordance with the disclosure set forth herein.

With continued reference to FIG. 16, in certain embodiments, respective dielectric separators 1625A-D may be woven helically between the individual conductors or conductive elements of one or more of the twisted pairs 1605A-D. In other words, a dielectric separator (generally referred to as dielectric separator 1625) may be helically twisted with the conductors of a twisted pair 1605 along a longitudinal length of the cable 1600. In certain embodiments, the dielectric separator 1625 may maintain spacing between the individual conductors of the twisted pair 1605. As illustrated in FIG. 16, a dielectric separator 1625 may be formed as a relatively simple film layer that is positioned between the individual conductors of a twisted pair 1605. In other embodiments, such as the embodiment illustrated in FIG. 17, a dielectric separator 1625 may be formed with a cross-section (e.g., an X-shaped cross-section, an H-shaped cross-section, etc.) that additionally assists in maintaining the position(s) of one or both the individual conductors of a twisted pair. In other words, the dielectric separator may reduce or limit the ability of one or both of the individual conductors to shift, slide, or otherwise move in the event that certain forces, such as compressive forces, are exerted on the cable 1600. As desired in certain embodiments, a dielectric separator may be formed from a continuous shield structure manufactured or otherwise provided in accordance with the disclosure set forth herein.

FIG. 17 illustrates a cross-sectional view of another example cable 1700 that may incorporate one or more continuous shield structures. The cable 1700 of FIG. 17 may include components that are similar to the cables 1500, 1600 illustrated and described above with reference to FIGS. 15 and 16. Accordingly, the cable 1700 may include a plurality of twisted pairs 1705A-D disposed in a cable core. A separator 1710 may be disposed between at least two of the twisted pairs 1705A-D and may function to orient and/or provide desired spacing between two or more of the twisted pairs 1705A-D. An outer jacket 1715 may enclose the internal components of the cable 1700.

The separator 1710 illustrated in FIG. 17 has a different cross-sectional shape than the separators 1510, 1610 illustrated in FIGS. 15 and 16. In particular, the separator 1710 is a generally T-shaped separator that approximately bisects (or otherwise divides) the cable core and forms two channels along a longitudinal length of the cable 1700 in which the twisted pairs 1705A-D are disposed. For example, two twisted pairs 1705A, 1705B may be disposed in a first channel and the remaining two twisted pairs 1705C, 1705D may be disposed in a second channel. The T-shaped separator 1710 illustrated in FIG. 17 is merely one example of an alternative separator shape, and a wide variety of other separator shapes may be utilized as desired. Additionally, in certain embodiments, the separator 1710 may be formed from a continuous shield structure manufactured or otherwise provided in accordance with the disclosure set forth herein.

Additionally, any number of shield layers may be utilized to provide shielding for the twisted pairs 1705A-D. For example, a first shield layer 1720 may be wrapped or otherwise formed around two of the twisted pairs, such as the twisted pairs 1705A, 1705B disposed in the first channel. A second shield layer 1725 may be wrapped or otherwise formed around other twisted pairs, such as twisted pairs 1705C, 1705D disposed in the second channel. In other words, shield layers may be provided for various groups of twisted pairs disposed within the cable core. In certain embodiments, the one or more of the shield layers 1720, 1725 may be formed from a continuous shield structure manufactured or otherwise provided in accordance with the disclosure set forth herein.

With continued reference to FIG. 17, respective dielectric separators 1730A-D having an H-shaped cross-section may be disposed or positioned between the individual conductors of the various twisted pairs 1705A-D. As described in greater detail above with reference to FIG. 16, these dielectric separators 1730A-D may assist in maintaining the position(s) of one or both the individual conductors of the twisted pairs 1705A-D. Dielectric separators may also be formed with a wide variety of other cross-sectional shapes and/or dimensions. Additionally, in certain embodiments, one or more of the dielectric separators 1730A-D may be formed from a continuous shield structure manufactured or otherwise provided in accordance with the disclosure set forth herein.

As desired in various embodiments, a wide variety of other materials may be incorporated into a cable, such as any of the cables 1500, 1600, 1700 illustrated in FIGS. 15-17. For example, a cable may include any number of conductors, twisted pairs, optical fibers, and/or other transmission media. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), insulating materials, dielectric materials, flame retardants, flame suppressants or extinguishants, gels, and/or other materials. The cables illustrated in FIGS. 15-17 are provided by way of example only. Other cables may include more or less components than the cables illustrated in FIGS. 15-17. Additionally, certain components may have different dimensions and/or materials than the components illustrated in FIGS. 15-17.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for forming a continuous shield for use in a cable, the method comprising:

providing a first layer of dielectric material that extends in a longitudinal direction;

forming a second layer of electrically conductive material on the first layer of dielectric material, the second layer comprising a thickness between 0.5 mils and 3.0 mils and extending in the longitudinal direction; and forming, at a plurality of spaced locations along the longitudinal direction, respective gaps through both the first layer and the second layer, each gap spanning partially across a width of the second layer, wherein, at each of the plurality of spaced locations, the gaps result in the formation of one or more fusible elements of the electrically conductive material spanning between an adjacent set of longitudinally spaced segments of the electrically conductive material, and wherein each fusible element provides electrical continuity between the adjacent set of longitudinally spaced segments and has a minimum fusing current between 0.001 amperes and 0.500 amperes.

2. The method of claim 1, wherein forming a second layer of electrically conductive material comprises providing a metal foil layer.

3. The method of claim 1, wherein providing a first layer comprises providing a first layer having a first width, and wherein forming a second layer of electrically conductive material comprises forming a second layer of electrically conductive material having a second width less than the first width.

4. The method of claim 1, wherein forming gaps comprises forming A gaps with one of a group consisting of (i) a punch, (ii) a blade, and (iii) a laser.

5. The method of claim 1, wherein forming gaps comprises forming at least one gap spanning partially across the width of the second layer at an angle that is perpendicular to the longitudinal direction.

6. The method of claim 1, wherein forming gaps comprises forming at least one gap spanning partially across the width of the second layer at an angle that is not perpendicular to the longitudinal direction.

7. The method of claim 1, wherein forming gaps comprises forming a plurality of gaps at one of the plurality of spaced locations.

8. The method of claim 1, wherein forming gaps comprises forming at least one gap having a curve.

9. The method of claim 1, wherein forming gaps comprises forming at least one gap having a width that tapers along the width of the second layer.

10. The method of claim 1, wherein forming a second layer of electrically conductive material on the first layer of dielectric material comprises forming a plurality of layers of electrically conductive material that extend in parallel in the longitudinal direction, and wherein forming gaps comprises forming respective gaps corresponding to each respective layer of electrically conductive material.

11. The method of claim 10, further comprising:

cutting, subsequent to forming gaps, the first layer of dielectric material along the longitudinal direction between two layers of electrically conductive material.

12. The method of claim 1, wherein the first layer of dielectric material is positioned on a first side of the second layer of electrically conductive material, and further comprising:

providing a third layer of dielectric material on an opposite side of the second layer of electrically conductive material.

13. The method of claim 12, wherein providing a third layer of dielectric material comprises providing a third layer of dielectric material following the formation of gaps.

14. The method of claim 1, further comprising:

subsequent to forming gaps and without taking up the continuous shield, incorporating the continuous shield into a cable comprising one or more transmission media.

15. A method for forming a continuous shield for use in a cable, the method comprising:

providing a longitudinally extending structure comprising a dielectric substrate and electrically conductive material formed on the dielectric substrate;

forming one or more openings through the structure at a plurality of spaced locations along the longitudinal direction with a respective longitudinal distance between each set of adjacent spaced locations being at least 3.0 cm, wherein each opening spans partially across a width of the electrically conductive material, wherein, at each of the plurality of spaced locations, the respective one or more openings result in the formation of one or more fusible elements of the electrically conductive material spanning between an adjacent set of longitudinally spaced segments of the electrically conductive material, and wherein each fusible element provides electrical continuity between the adjacent set of longitudinally spaced segments and has a minimum fusing current between 0.001 amperes and 0.500 amperes.

16. The method of claim 15, wherein forming one or more openings comprises forming one or more openings with one of a group consisting of (i) a punch, (ii) a blade, and (iii) a laser.

17. The method of claim 15, wherein forming one or more openings comprises forming at least one openings having a curve.

18. The method of claim 15, wherein forming one or more openings comprises forming at least one opening having a width that tapers along the width of the electrically conductive material.

19. The method of claim 15, wherein the dielectric substrate is positioned on a first side of the electrically conductive material, and further comprising:

providing, subsequent to forming one or more openings, a layer of dielectric material on an opposite side of the electrically conductive material.

20. A method for forming a continuous shield for use in a cable, the method comprising:

providing a longitudinally extending structure comprising a dielectric substrate and electrically conductive material formed on the dielectric substrate, the electrically conductive material comprising a thickness between 0.5 mils and 3.0 mils;

forming one or more openings through the structure at a plurality of spaced locations along the longitudinal direction, wherein the one or more openings result in the formation of longitudinally spaced segments of the electrically conductive material with one or more fusible elements spanning between each adjacent set of longitudinally spaced segments of electrically conductive material, wherein each fusible element provides electrical continuity between the adjacent set of longitudinally spaced segments and has a minimum fusing current between 0.001 amperes and 0.500 amperes.

* * * * *